United States Patent [19]

Nakamura et al.

[11] 4,346,574

[45] Aug. 31, 1982

[54] LOCK DEVICE OF THE PUSHBUTTON SYSTEM

[76] Inventors: Katori Nakamura; Hisako Nakamura, both of No. 18-17, Okuzawa 6-chome, Setagaya-ku, Tokyo, Japan

[21] Appl. No.: 194,893

[22] Filed: Oct. 1, 1980

[30] Foreign Application Priority Data

Oct. 17, 1979 [JP] Japan ..... 54-133758
Nov. 17, 1979 [JP] Japan ..... 54-148329
May 16, 1980 [JP] Japan ..... 55-64022

[51] Int. Cl.[3] ..... E05B 37/00
[52] U.S. Cl. ..... 70/313; 70/298
[58] Field of Search ..... 70/313, 297, 298, 299, 70/213, 214, 219, 220

[56] References Cited

U.S. PATENT DOCUMENTS 4,087,995 5/1978 Guireud ..... 70/299
4,274,272 6/1981 Wang ..... 70/214

FOREIGN PATENT DOCUMENTS 2746123 6/1978 Fed. Rep. of Germany ..... 70/313

*Primary Examiner*—Robert L. Wolfe
*Attorney, Agent, or Firm*—Toren, McGeady, Stanger

[57] ABSTRACT

A mechanical lock device dispensing with a key capable of unlocking a dead bolt from outside the room when pushbuttons of a number r out of a total number of n are depressed and a locking and unlocking bar of a lock unit and a locking and unlocking member connected thereto are rendered rotatable. The locking and unlocking member is fitted in a control slider. In the control slider, there is disposed a control pin which controls the transmission of the sliding movement of an intermediate slider to the dead bolt. The intermediate slider can be operated by turning a grip. The control pin is controlled by a sub-control slider. In the lock unit, there are disposed two sliding plates which can be carried in accordance with the movement of a permutation driving plate.

In the standby position, one of the sliding plates is carried by the permutation driven plate and the non-stop portion of the sliding plate is in a position shifted in its movement direction by one stage distance from the locking and unlocking bar, while the other sliding plate is carried by the permutation start plate and its non-stop portion is shifted by one stage from the locking and unlocking bar.

12 Claims, 28 Drawing Figures

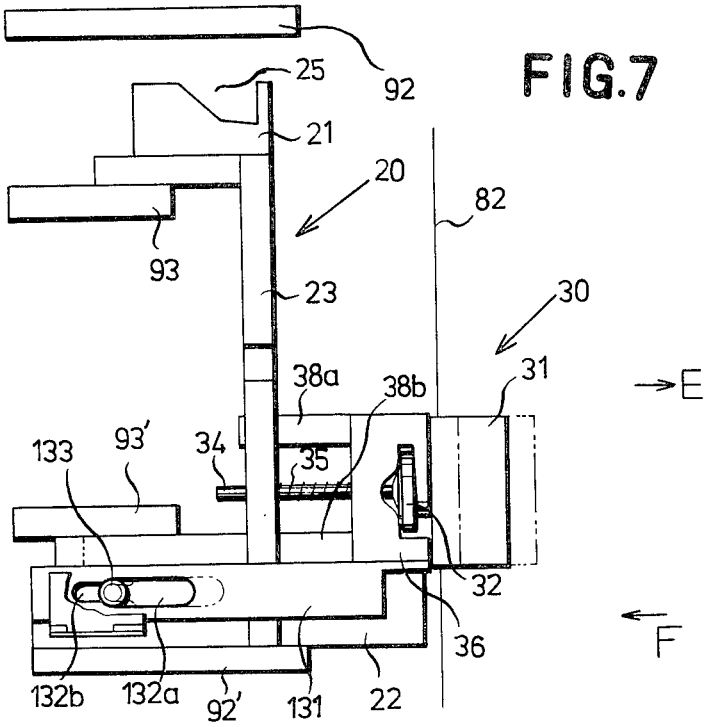
FIG.7
FIG.8
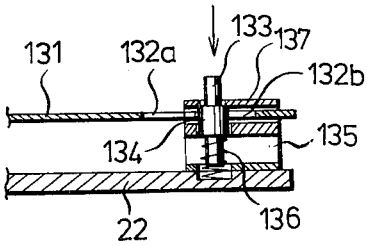
FIG.9
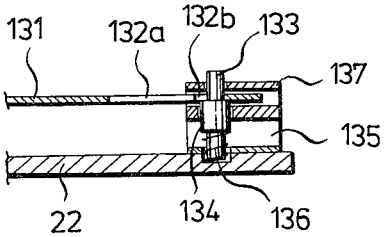

LOCK DEVICE OF THE PUSHBUTTON SYSTEM

BACKGROUND OF THE INVENTION

The present invention relates to a purely mechanical lock device of the pushbutton system dispensing with a key and more particularly to a lock device of the type described which is of a mortise lock type.

As a prior-art lock device of a purely mechanical pushbutton type which dispenses a key, a padlock comprising two lock units is known in Japanese Laid-open patent application No. 55499/1975, which is constructed in such a manner that pushbuttons of a number r out of a total number of n are mechanically operated to the requirements for redering the padlock inoperative which conform to the permutation.

Further, a lock device of a mortise lock type using the lock units of the above-mentioned padlock is also proposed in Japanese Laid-open patent application No. 69799/1978. This lock device comprises a latch bolt operating mechanism capable of projecting a latch bolt into a mortise of a door and withdrawing the same from the mortise by turning a grip for opening and closing the door; a dead bolt operating mechanism for withdrawing the dead bolt into an end edge of the door through the latch bolt operating mechanism only when the lock units are in the unlocked state; an indoor unlocking mechanism for operating freely the dead bolt from inside the room; and a resetting mechanism for returning the lock units to the standby position by turning the grip for one receprocating operation of a reset lever.

In the lock device, the grip portion is disposed beside the above-mentioned mechanisms, and a locking and unlocking pawl of a locking and unlocking member connected to a locking and unlocking bar is made of an upright plate member. This requires that the locking and unlocking pawl be made comparatively great in height in order to move the dead bolt between a locked position in which the dead bolt is projected into the mortise and an unlocked position in which the dead bolt is withdrawn from the mortise. Therefore, in comparison with the conventional lock devices requiring keys, the lock device disclosed in Japanese Laid-open patent application No. 69799/1978 is wider and thicker, so that some difficulties are encountered when the lock device is attached to ordinary doors. Stated differently, the ordinary door comprises an outer frame, and a lock device is usually fitted within the frame. However, since the above-mentioned lock device is comparatively wide and thick, part of the frame of the door has to be cut off for attaching the lock device to the door, which may weaken the door and may cost much. Furthermore, the grip has to be located away from the usual position in the direction of the center of the door.

In the conventional lock device, when the dead bolt is in the locked position, the dead bolt itself is not locked at all, but it is simply projected into the mortise. Therefore, the dead bolt cannot be maintained fixedly in the locked position. Therefore, there is a risk that the dead bolt can be withdrawn from the mortise with ease when the door is vibrated or the dead bolt is moved by use of a pin or the like. This is a shortcoming of the conventional lock device in view of the safety.

Further, in the conventional lock device, a control slider includes a seesaw member, and a control pin of the seesaw member is brought into engagement with a notch of an intermediate slider, whereby the control slider is connected to the intermediate slider. However, a control projection for controlling the seesaw member of the control slider is secured to the dead bolt, so that the dead bolt is completely in the free state except at a position in which the dead bolt is completely moved to the unlocked position. In other words, the intermediate slider and the control slider are connected to each other in the locked state. However, since the dead bolt is completely in the free state, if the dead bolt is moved between the unlocked position and the locked position for some reason, the control projection is also moved together with the dead bolt. Therefore, the control pin disengages from the notch of the intermediate slider. In this case, even if the lock units are in the unlocked state, the dead bolt cannot be moved by turning the grip. This is a problem to the dead bolt operating mechanism.

Furthermore, the lock unit employed in the above-mentioned conventional lock device comprises a rotatable locking and unlocking bar which is in engagement with a locking and unlocking member; a permutation driving plate and a permutation driven plate which are indenpendently moved by a predetermined distance (hereinafter referred to as one stage) when their respective pushbuttons are depressed, and a sliding plate which is carried by the permutation driven plate and is capable of moving relative to the permutation driven plate in a direction parallel to the permutation driven plate. In the lock unit, the sliding plate is carried by the permutation driving plate and is then further moved by the permutation driven plate from a rotation prevention position in which the locking and unlocking bar cannot be rotated to a rotation prevention release position in which the locking and unlocking bar can be rotated.

Further, in Japanese Laid-open patent application No. 55499/1975 there is desclosed a lock unit provided a safety plate which is operated by depressing a pushbutton which belongs to the safety plate and is different from the pushbuttons belonging to the permutation driving plate, the permutation driven plate and the sliding plates. The safety plate is capable of moving relative to the locking and unlocking bar, that is, from the rotation prevention position to the rotation prevention release position and vice versa.

A lock unit of the permutation operation type described can make a great contribution to making lock devices small in size by combining the safety plate and the movable permutation plates appropriately, and to the guarantee of safety by disposing pushbuttons which must not be depressed for unlocking the lock devices.

However, the lock unit mentioned above has a shortcoming in that there are several modes of depressing the pushbuttons of the lock unit for bringing the lock unit to the unlocking state (hereinafter referred to as unlocking-pushbutton-depression mode).

Let us assume that there are four pushbuttons W, X, Y and Z, which respectively belong to a permutation driving plate, a permutation driven plate, a prevention operation safety plate and a relase operation safety plate. In this lock unit, the unlocking requirement is met when the pushbutton W is depressed prior to the depression of pushbutton X, and the pushbutton Y can be depressed any time. Therefore, there are three unlocking-pushbutton-depression modes, WXY, WYX and YWX. On the other hand, in another lock unit, if the pushbutton W is for a permutation driving plate; the pushbutton Y for a permutation driven plate; the pushbutton X for a prevention operation safety plate and the pushbutton Z for a release operation safety plate, the unlocking-pushbutton-depression modes are WYX, WXY and XWY. Comparing these pushbutton depression modes with the above-mentioned unlocking-pushbutton-depression modes, WXY and WYX modes are common. Therefore, the two unlocking-pushbutton-depression modes WXY and WYX satisfy the unlocking requirement of both lock units.

Furthermore, the unlocking requirement of the above-mentioned lock units with respect to the permutation driving plate and the permutation driven plate is that the sliding plate be moved by one stage in accordance with the movement of the permutation driving plate, and the sliding plate be then moved by another stage together with the permutation driven plate, so that the sliding plate be moved by two stages. Therefore, if the permutation driven plate is moved before the permutation driving plate is moved, the sliding plate is not pushed by the permutation driving plate. The result is that the sliding plate is moved only one stage and, the unlocking requirement is not met in this case.

In the conventional lock units, if the permutation driven plate is moved before the permutation driving plate, the sliding plate is advanced, due to the inertia force thereof, relative to the permutation driven plate when the permutation driven plate is stopped. If the advanced distance of the sliding plate from the permutation driven plate nearly equals one stage, it causes a malfunction in the lock units, so that the lock device is unlocked when it must not be unlocked.

Furthermore, in the conventional lock units, the sliding plate is held tightly by a plate spring situated above the sliding plate when the sliding plate is stopped and the space for the plate spring makes it difficult to make the lock units thinner.

SUMMARY OF THE INVENTION

It is therefore an object of the present invention to provide a lock device of the mortise type using at least one lock units of a purely mechanical pushbutton system, which is capable of holding a dead bolt in a lock position and ensuring high safety.

Another object of the present invention is to provide a lock device of the type described capable of securely controlling a seesaw member of a control slider.

A further object of the present invention is to provide a lock device of the type described which is smaller in width and thickness than conventional lock devices.

Still another object of the present invention is provide a lock device of the type described which is capable of moving a reset lever smoothly.

Still another object of the present invention is to provide a lock device of the type described employing lock units whose unlocking-pushbutton-depression modes are different from each other.

Still another object of the present invention is to provide a lock device of the type described employing lock units capable of preventing any malfunction due to the inertia force of the sliding plates in the lock units.

Still another object of the present invention is to provide a lock device whose lock units are smaller in width and thickness than conventional lock units.

BRIEF DESCRIPTION OF THE DRAWINGS

In the drawings,

FIG. 7 is a front view of the intermediate slider and the latch bolt;

FIG. 8 and FIG. 9 are sectional views in explanation of the operation of a mechanism for rotating the latch bolt;

DETAILED DESCRIPTION OF THE PREFERRED EMBODIMENT

Figure 1:
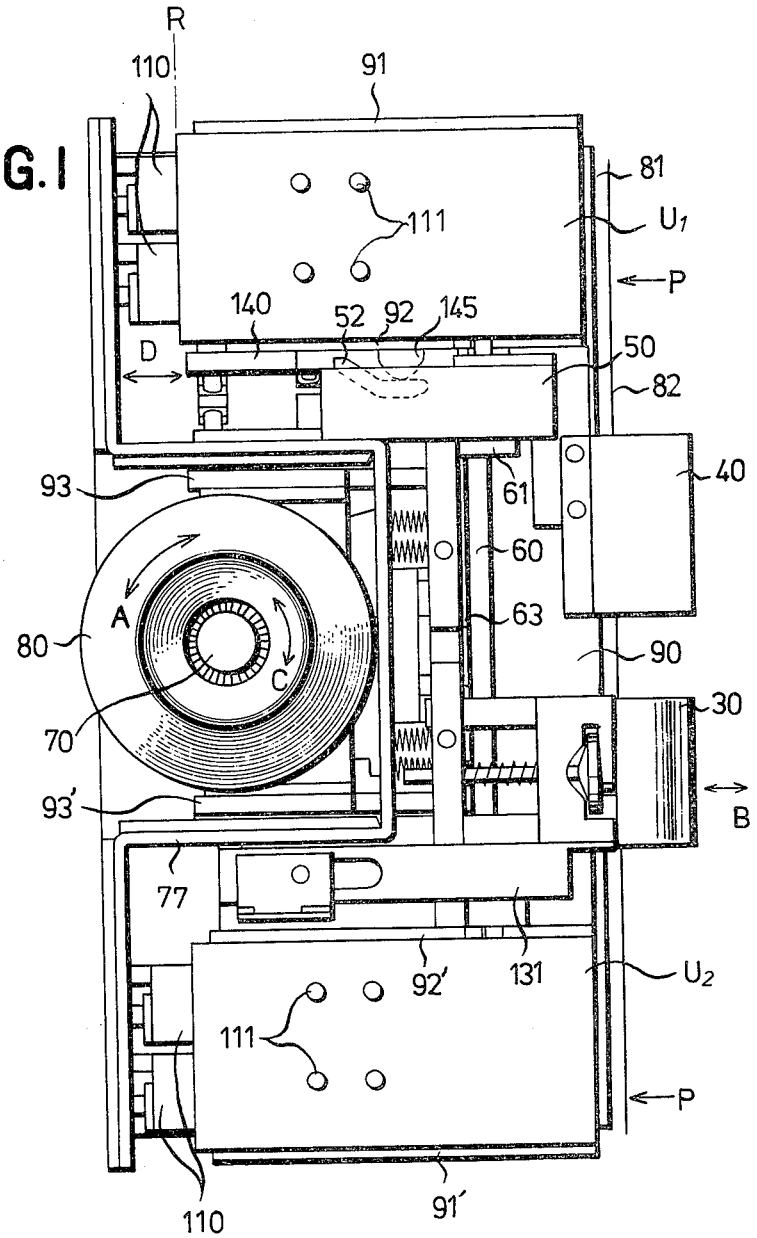
FIG. 1 is a front view of a lock device of a mortise lock type according to the present invention.

Referring to FIG. 1, there is shown an embodiment of a lock device of a mortise lock type according to the present invention. As shown in FIG. 1, the lock device comprises a latch bolt operation mechanism for projecting and withdrawing a latch bolt 30 in the directions of arrow B from an end edge 82 of a door 81 by turning a grip 80 for opening and closing the door, in the directions of arrow A; a cartridge mechanism for holding a lock unit U1 and a lock unit U2 in such a manner that the lock units U1 and U2 are detachable therefrom; a dead bolt operation mechanism capable of withdrawing a dead bolt 40 into the end edge 82 of the door 81 through the latch bolt operation mechanism only when the lock unit U1 and the lock unit U2 are both in the unlock state; an indoor unlocking mechanism for permitting the dead bolt 40 to be operated freely from inside the room; a reset mechanism for returning the lock units U1 and U2 to a standby position by one reciprocating movement of a reset lever 77 in the directions of arrow D and turning a knob 70 in the direction of arrow C; and a latch bolt rotation mechanism for rotating an inclined surface of the latch bolt 30 towards the closing direction of the door.

Figure 2:
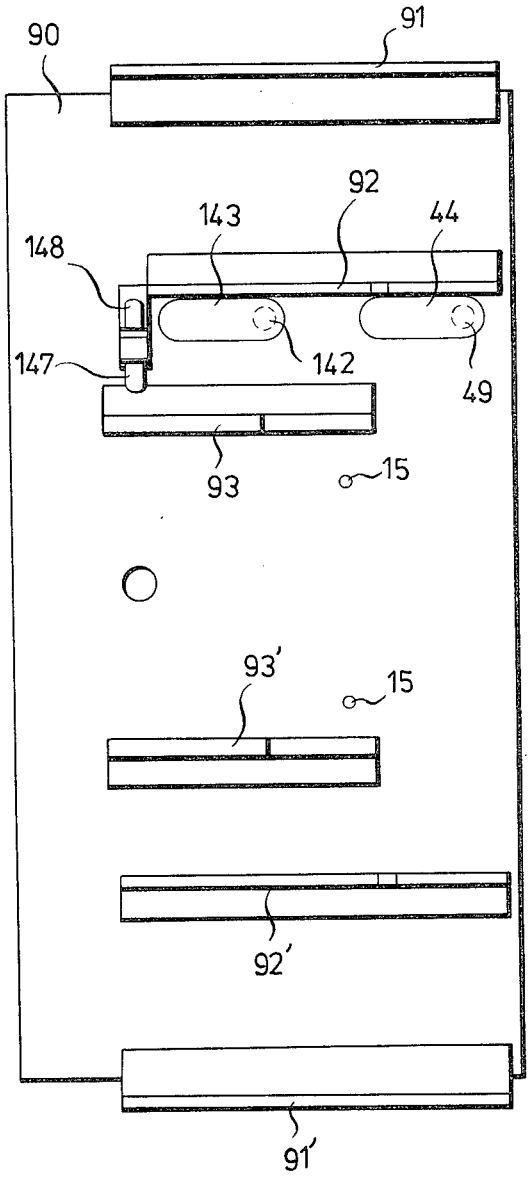
FIG. 2 is a front view of the lock device according to the present invention, with an intermediate slider, a latch bolt, a control slider and a dead bolt being removed.
Figure 3:
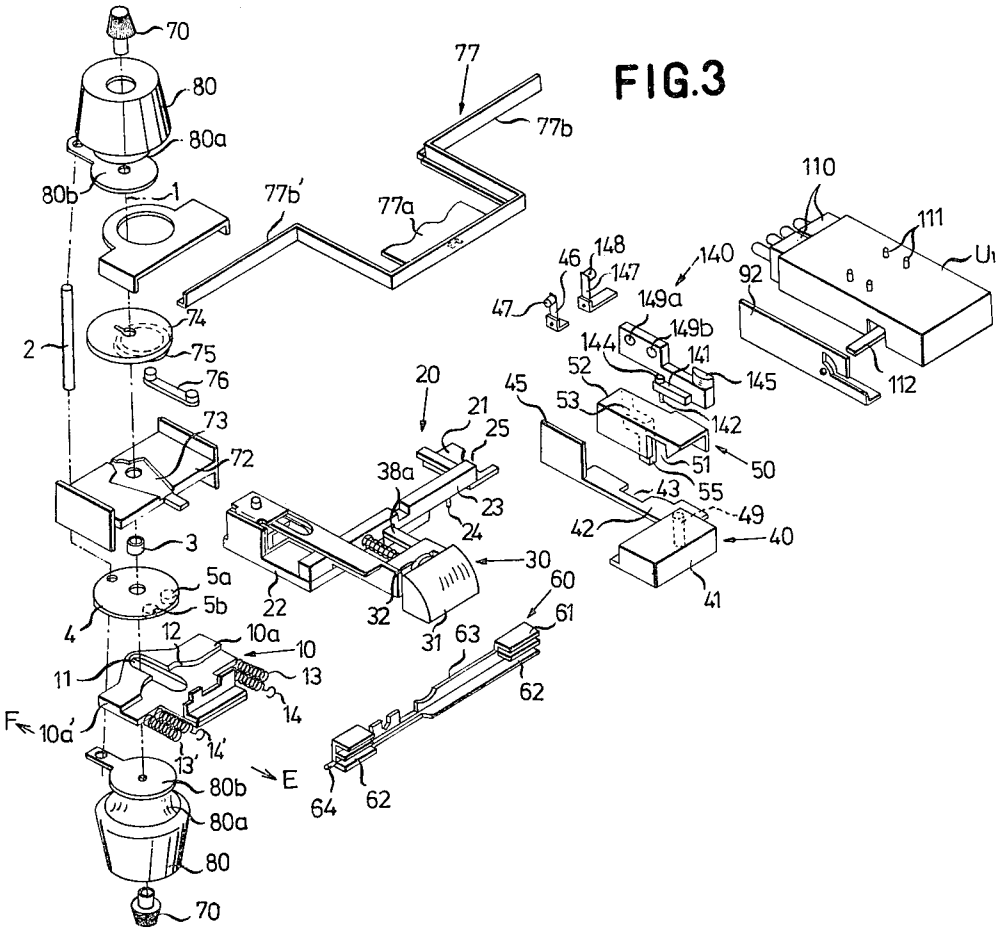
FIG. 3 is an exploded perspective view of the lock device in FIG. 1.

Referring to FIGS. 1, 2 and 3, in a casing base plate 90, there are disposed a pair of side wall plates 91 and 91' and a pair of partition plates 92 and 92', which are disposed parallel to each other. The side wall plate 91 and the partition plate 92 constitute a holding portion for holding the lock unit U1 therein, while the side wall plate 91' and the partition plate 92' constitute a holding portion for holding the lock unit U2 therein. In this embodiment, the lock unit U1 and the lock unit U2 are of a permutation operation type having movable plates 110, such as permutation driving plates and permutation driven plates. The lock units U1 and U2 can be fitted into their respective holding portions by pushing them in the direction of arrow P. Between the partition plates 92 and 92', there is disposed a locking and unlocking member 60 which is rotatably supported by pins 64 at opposite ends thereof fitted into the partition plates 92 and 92'. In the locking and unlocking member 60, on the side thereof facing the dead bolt 40, there is formed a fitting groove 62, extending in the rotation-axis direction thereof (refer to FIG. 3). The top portions of locking and unlocking bars 112 of the lock units U1 and U2 are each fitted in the fitting groove 62, passing through the partition plates 92 and 92'. The locking and unlocking bars 112 can be rotated so long as pushbuttons 111 are depressed in the proper order so as to satisfy the unlocking requirements of the lock units U1 and U2. However, since the locking and unlocking bars 112 of the lock units U1 and U2 are connected to each other through the locking and unlocking member 60, the locking and unlocking bar 112 and the locking and unlocking member 60 cannot be rotated unless the unlocking requirements of both the lock unit U1 and the lock unit U2 are met. Further, since the locking and unlocking member 60 is in engagement with the dead bolt 40 through a control slider 50 which will be described later, the dead bolt 40 cannot be withdrawn from its corresponding mortise (not shown) unless the unlocking conditions of both the lock unit U1 and the lock unit U2 are satisfied. Between the partition plates 92 and 92', guide plates 93 and 93' for respectively guiding slidably a driving slider 10 and an intermediate slider 20 are secured to the casing base plate 90.

Latch Bolt Operating Mechanism

Figure 4:
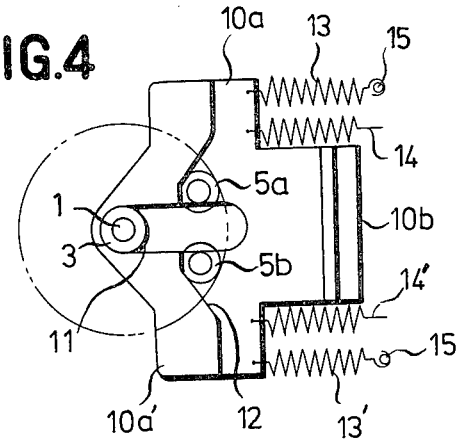
FIG. 4 and FIG. 5 are views in explanation of the interlocking operation of a step portion of a driving slider which is in engagement with pressure application projections.

Referring to FIG. 3, the grip 80 is supported at either end of a shaft 1 for rotation relative to the shaft 1. Each grip 80 includes an inwardly extending shaft portion **80*a* which has attached to its end surface a plate-like member 80*b*. The two plate-like members 80*b* and 80*b* are interconnected by a connecting rod 2. A disc 4 rotatably supported by the shaft 1 is interposed between the two grips 80, 80 and formed therein with an opening 4*a* through which, the connecting rod 2 extends. The grips 80, 80 and the disc 4 are rotatable as a unit about the shaft 1. The disc 4 is formed thereon with two ring-shaped pressure applying projections 5*a* and 5*b* which are located in a peripheral portion of the disc 4 in a position which is diametrically opposed to the opening 4*a*. The pressure applying projections 5*a* and 5*b* are rotatably attached to the disc 4. The driving slider 10 is disposed under the pressure applying projections 5*a* and 5*b* of the disc 4 in FIG. 3. The shaft 1 extends through a slot 11 formed in the driving slider 10. The slot 11 extends in the movable direction of the driving slider 10. Reference numeral 3 represents a spacer ring which is fitted into the slot 11. On the upper surface of the driving slider 10, a step portion 12 in the shape of a chevron is formed into which the slot 11 extends as shown in FIG. 3. As shown in FIG. 4, the driving slider 10 includes two wing portions of the wing portions 10*a* and 10*a'* respectively extend near the guide plates 93 and 93'**.

Figure 5:
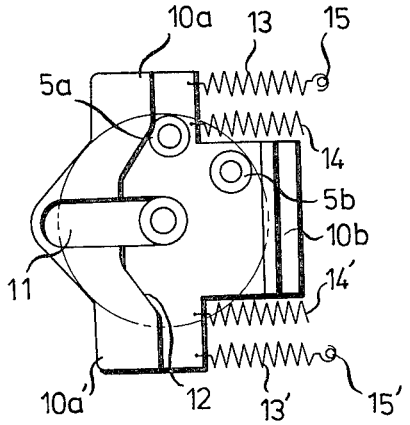
Figure 6:
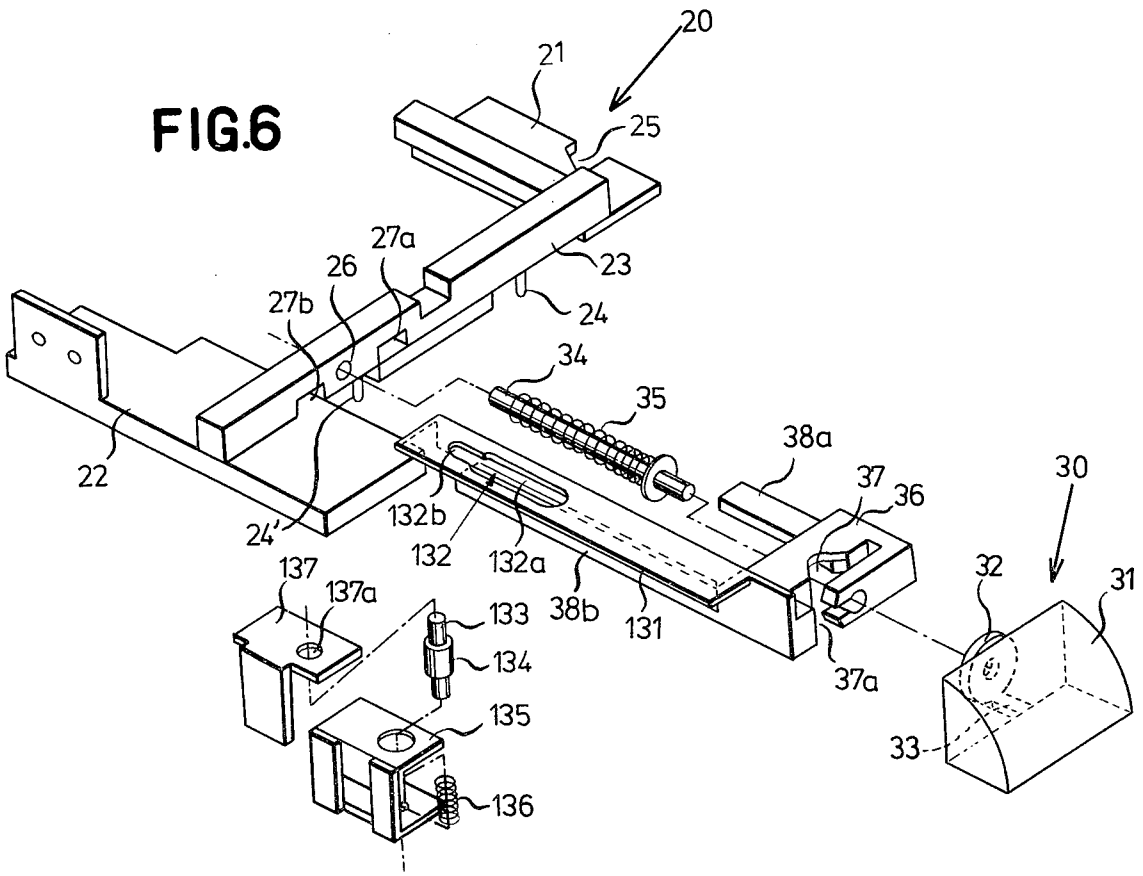
FIG. 6 is an exploded perspective view of the intermediate slider and the latch bolt in the lock device according to the present invention.

To the wing portion **10*a* and the wing portion 10*a'*, a pair of springs 13 and 14 and another pair of springs 13' and 14' are respectively connected. The springs 14 and 14', which are stronger than the springs 13 and 13'. are respectively disposed parallel to the springs 13 and 13'. The other ends of the springs 13 and 13' are respectively connected to pins 15 and 15' fixed to the casing base plate 90, while the other ends of the springs 14 and 14' are respectively connected to pins 24 and 24' secured to the intermediate slider 20 which will be described in detail later. The driving slider 10 is urged by the springs 13, 13', 14 and 14' in the direction of arrow E in FIG. 3, whereby the step portion 12 of the driving slider 10 is held at all times in contact with the peripheries of the pressure applying projections 5*a* and 5*b* as shown in FIG. 4. Therefore, if the disc 4 is rotated in either direction by turning the grip 80, the driving slider 10 slides in the direction of arrow F in FIG. 3. This is because, if the disc 4 disposed in the position shown in FIG. 4, for example, is rotated, the projections 5*a* and 5*b* which have been disposed parallel to the step portion 12 change their positions as the disc 4 rotates until they are disposed at a right angle to the step portion 12 as shown in FIG. 5. One end of each of the springs 14 and 14' is connected to the driving slider 10, and the other ends of the spring 14 and 14' are respectively connected to the pins 24 and 24' which are substantially secured to the intermediate slider 20. The intermediate slider 20 includes two sliding plates 21 and 22, which are disposed apart from each other, but connected by a connection bar 23 as shown in FIG. 3 and FIG. 6. The sliding plate 21 is disposed between the partition plate 92 and the guide plate 93, while the sliding plate 22 is disposed between the partition plate 92' and the guide plate 93' (refer to FIG. 7). When the intermediate slider 20 is moved by the driving slider 10, the sliding plate 21 guided by the guide plate 93, slides, and at the same time the sliding plate 22 is guided by the guide plate 93' and the partition plate 92'. In the sliding plate 21, there is formed a notch 25 for transmitting the sliding movement of the intermediate slider 20 to a dead bolt operating mechanism which will be described later. On the side of the sliding plate 22, viewed from the center of the intermediate slider 20, there are disposed the latch bolt 30 and a latch bolt rotation mechanism. The pins 24 and 24' are secured to the connection bar 23**.

The latch bolt 30 comprises a latch bolt top portion 31 with a curved, inclined surface, and a ring-shaped member 32 with a hole formed in the central portion thereof. The latch bolt top portion 31 and the ring-shaped member 32 are connected integrally to each other by a connection member 33. Into the central hole of the ring-shaped member 32, one end portion of guide shaft 34 is rotatably fitted. However, the latch bolt 30 cannot be rotated freely since the base portion of the latch bolt 30 comes into contact with the casing base plate 90 if it is tried to rotate the latch bolt 30. The guide shaft 34 has a coil spring 35 mounted around it. The other end portion of the guide shaft 34 is loosely fitted into a hole 26 formed in the connection bar 23 of the intermediate slider 20. Since the diameter of the hole 26 smaller than that of the coil spring 35, the end of the coil spring 35 is in pressure contact with the connection bar 23, whereby the latch bolt 30 is urged in the direction of the end edge 82 of the door 82. However, the latch bolt 30 is stopped by a pin 133 (which will be mentioned later) which is fitted into a slot 132 formed in a movable plate 131 secured to a latch bolt support member 36. The latch bolt support member 36 includes two guide rods 38*a* and 38*b*. Further, in the latch bolt support member 36, a cutout 37 is formed in which the ring-shaped member 32 is loosely fitted. The cutout 37 also has an opening portion 37*a* which allows the connection member 33 for connecting the ring-shaped member 32 to the top portion 31 of the latch bolt 30 to pass therethrough (refer to FIG. 6). As mentioned above, the two guide rods 38*a* and 38*b* and the movable plate 131 are secured to the latch bolt support member 36. The guide rods 38*a* and 38*b* are respectively fitted into guide holes 27*a* and 27*b* which are formed in the connection bar 23 of the intermediate slider 20.

It is required that the inclined surface of the latch bolt 30 be directed in the closing direction of the door. Therefore, depending the desired opening and closing directions of the door, the direction of the inclined surface of the latch bolt 30 has to be changed. Conventionally, a lock device with a latch bolt having the inclined surface directed in the desired direction is selected, depending upon the circumstances. However, in the lock device according to the present invention, the direction of the inclined surface of the latch bolt 30 can be changed by a simple mechanism which will be now explained.

Referring to FIG. 6, in the movable plate 131, there is formed the slot 132 including a large-diameter slot portion 132*a* and a small-diameter slot portion 132*b* which are connected to each other. In the slot 132, a pin 133 is fitted. In the central portion of the pin 133, there is formed a large-diameter portion 134 which is larger in diameter than the other portions of the pin 133. The diameter of the large, diameter portion 134 is smaller than the large-diameter slot portion 132*a*, but greater than the small-diameter slot portion 132*b*. Further, the diameter of the small-diameter portion of the pin 133 is smaller than the small-diameter slot portion 132*b*. The pin 133 is fitted into a fixing member 135 in the shape of an inverted letter U in cross section. The fixing member 135 is secured to the sliding plate 22 of the intermediate slider 20. The pin 133 has a compressed coil spring 136 mounted around it. One end of the coil spring 136 is fixed to a lower end of the fixing member 135, while the other end of the coil spring 136 is in pressure contact with the lower peripheral and of the large-diameter portion 134 of the pin 133, whereby the pin 133 is always urged upwards. Since the upper peripheral end of the large-diameter portion 134 of the pin 133 is in pressure contact with the periphery of a hole 137*a* formed in a holding plate 137. Which is disposed so as to cover the movable plate 131, the pin 133 is stopped (refer to FIG. 3 and FIG. 6), whereby the large-diameter portion 134 of the pin 133 is fitted in the large-diameter slot portion 132*a* of the movable plate 131.

Since the movable plate 131 is secured to the latch bolt support member 36, the movable plate 131 is urged outwardly together with the latch bolt 30, by the biasing force of the coil spring 35. However, since the pin 133 is fitted into the slot 132 of the movable plate 131, the movable plate 131 is stopped and accordingly the latch bolt 30 is stopped. However, if a force is exerted on the latch bolt 30 in the direction of arrow F in FIG. 7, the latch bolt 30 is guided by the guide rods 38*a* and 38*b* and moves against the biasing force of the coil spring 35 into the end edge 82 of the door 81. Since the movable plate 131 slides together with the latch bolt 30, large-diameter slot portion 132*a* is formed so as to be slightly longer in the longitudinal direction than the movable distance of the latch bolt 30.

When the direction of the inclined surface of the latch bolt 30 is changed when attaching the lock device to a door, the pin 133 is depressed against the biasing force of the compressed coil spring 136 as shown in FIG. 7 and FIG. 8, whereby the large-diameter portion 134 of the pin 133 is disengaged from the large-diameter slot portion 132*a*, and instead the small-diameter portion of the pin 133 is fitted into the small-diameter slot portion 132*b*. Therefore, the movable plate 131 is caused to slide in the direction of arrow E by the biasing force of the coil spring 35 and is then stopped when the pin 133 comes into contact with the rear end of the small-diameter slot portion 132*b*. When the latch bolt 30 is thus projected, the latch bolt 30 is rotated in a direction in which the connection member 33 passes through the opening portion 37*a*, whereby the direction of the inclined surface of the latch bolt 30 can be reversed relative to the guide shaft 34, without any hindrance of the door 81 and of the casing base plate 90. When the inclinded surface of the latch bolt 30 is directed in the right direction, the top portion 31 of the latch bolt 30 is depressed in the direction of arrow F, whereby the movable plate 131 is also caused to slide in the same direction and the small-diameter portion of the pin 133 is disengaged from the small-diameter slot 132*b* and, at the same time, the pin 133 is moved upwards by the biasing force of the coil spring 136, so that the large-diameter portion 134 of the pin 133 is brought into engagement with the large-diameter slot portion 132*a*. As a result, the latch bolt 30 is stopped at its original position.

When the grip 80 is rotated in either direction, the disc 4 is rotated in the same direction, so that the driving slider 10 is caused to slide in the direction of arrow F in FIG. 3 against the biasing forces of the springs 13, 13', 14 and 14'. The sliding direction of the driving slider 10 is regulated by the slot 11 and the guide plates 93 and 93'. The driving slider 10 is connected to the intermediate slider 20 via the coil springs 14 and 14', so that when the driving slider 10 slides, the intermediate slider 20 also slides together with the driving slider 10. Since the latch bolt 30 is connected to the intermediate slider 20 by the sliding plate 22, the latch bolt 30 also moves together with the intermediate slider 20. Thus, by rotating the grip 80, the latch bolt 30 is withdrawn into the end edge 82 of the door 81 shown in FIG. 7. If the force exerted on the grip 80 is removed, the driving slider 10 will be restored to its original position by the biasing forces of the springs 13, 13', 14 and 14', and the intermediate slider 20 will also be restored to its original position together with the driving slider 10 by the biasing forces of the springs 14 and 14'. In order to return the intermediate slider 20 to its original position securely, an upright portion is formed in the tail portion 10*b* of the driving slider 10. The rotatable range of the grip 80 is limited by the slot 11 formed in the driving slider 10.

The driving slider 10 is disposed between the guide plates 93 and 93' so as to slide along the guide plates 93 and 93' while the sliding plates 21 and 22 are respectively disposed so as to slide along the outer sides of the guide plates 93 and 93'. Furthermore, the driving slider 10 and the intermediate slider 20 are disposed in such a manner that their sliding areas overlap. Therefore, the lock device according to the present invention is made compact in width in comparison with conventional lock devices.

Dead Bolt Operating Mechanism

Figure 10:
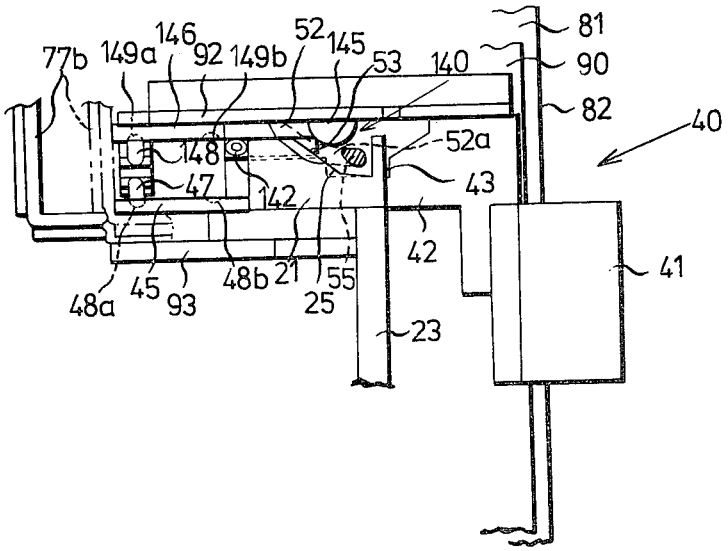
FIG. 10 is a front view of the dead bolt in the locked position.

Referring to FIG. 3 and FIG. 10, the dead bolt 40 comprises a solid head 41 and a dead bolt support member 42. The dead bolt support member 42 is placed on the casing base plate 90 and is disposed between the partition plate 92 and the guide plate 93. The sliding plate 21 of the intermediate slider 20 is placed on the dead bolt support member 42 in slide contact therewith.

A notch 43 is formed in the dead bolt support member 42 in such a position that the notch 25 of the sliding plate 21 and the notch 43 approximately overlap each other when the dead bolt 40 is projected and the intermediate slider 20 is in the normal position as shown in FIG. 1. The notch 43 is formed slightly longer in the sliding direction of the dead bolt support member 42 than the notch 25. Further, a guide pin 49 projects downwardly from the underside of the dead bolt support member 42 at a position thereof near the solid head 41. The guide pin 49 is received in a slot 44 (refer to FIG. 2) formed in the casing base plate 90 when the dead bolt 40 is placed on the casing base plate 90. The dead bolt 40 is capable of moving in sliding motion leftwardly and rightwardly in FIG. 10 on the casing base plate 90 as the guide pin 49 moves in the slot 44. To the rear end portion of the dead bolt support member 42, an upright portion 45 is fixed. In the upright portion 45, there are formed two pits 48*a* and 48*b*, either of which receives a pin 47 secured to the casing base plate 90 (refer to FIG. 10). The pin 47 is urged by a plate spring 46 so as to be brought into engagement with either of the pits 48*a* and 48*b*. When the dead bolt 40 is projected from the end edge 82 of the door 81 and is located at the lock position, the pin 47 is brought into engagement with the pin 48*a*, while when the dead bolt 40 is withdrawn into the end edge 82 and is located at the unlock position, the pin 47 is brought into engagement with the pit 48*b*. The locking and unlocking member 60 is situated above the dead bolt support member 42. A control slider 50 is situated above the overlapping portion of the dead bolt support member 42 and the sliding plate 21 of the intermediate slider 20. A cutout 51 is formed near the top portion of the control slider 50. A locking and unlocking pawl 61 in the shape of a letter E in cross section is formed in the locking and unlocking member 60, and the locking and unlocking pawl 61 is in engagement with the cutout 51. When the locking units U1 and U2 are both in the unlocking state, the locking and unlocking member 60 can be rotated as the control slider 50 slides. A rear half portion of the control slider 50 is in the shape of an inverted letter L. Arranged between the side walls of the rear half portion of the control slider 50 is a seesaw member 52 in the shape of a letter V in cross section which is pivotally supported by the side walls through a shaft 53. A control pin 55 projects downwardly from an arm 52*a* of the member 52, which arm 52*a* is disposed on the side of the locking and unlocking member 60. As the seesaw member 52 rotates, the control pin 55 engages with or disengages from the notch 25 of the sliding plate 21 and the notch 43 of the dead bolt support member 42. A sub-control slider 140 is disposed upright relative to the casing base plate 90, in slide contact with the partition plate 92 and adjacent to a position where the dead bolt support member 42 and the sliding plate 21 of the intermediate slider 20 overlap. A sliding member 141 is fixed to a lower end portion of the sub-control slider 140. A guide pin 142 projects from the bottom surface of the sliding member 141, extending through a slot 143 formed in the casing base plate 90, in such a manner as to be guided along the slot 143. When the sub-control slider 140 is placed on the casing base plate 90, the guide pin 142 is capable of sliding between a rearwardly withdrawn position and a forwardly projecting position which will be described later. A comparatively small pin 144 is secured to the upper surface of the sliding member 141. When the intermediate slider 20 is moved backwards, the rear edge of the sliding plate 21 of the intermediate slider 20 comes in contact with the pin 144 and pushes the same. In a top portion of the sub-control slider 140, a semi-circular control projection 145 is formed, which is in contact with the inner surface of the seesaw member 52. To the rear end of the sub-control slider 140, an upright plate 146 is secured, which is similar in shape to the upright portion 45 of the dead bolt support member 42. In the upright plate 146, pits 149*a* and 149*b* for registration is formed, with either of which an engagement pin 148 can be brought into engagement. The engagement pin 148 is secured to the casing base plate 90 through a plate spring 147. The engagement pin 148 is brought into engagement the pit 149*a* when the semi-circular control projection 145 comes to the previously mentioned forwardly projecting position where the control pin 55 of the seesaw member 52 of the control slider 50 is in engagement with both the notch 25 of the sliding plate 21 and the notch 43 of the dead bolt support member 42. On the other hand, when the control projection 145 comes to the rearwardly withdrawn position where the control pin 55 is out of engagement with the notches 25 and 43, the engagement pin 148 is brought into engagement with the pit 149*b*. Thus, by the engagement pin 148 and the pits 149*a* and 149*b*, the movement of the sub-control slider 140 is accurately regulated.

The dead bolt operating mechanism will now be explained. For the sake of convenience of explanation, the lock units U1 and U2 are assumed to be in the unlock state. In this state, the locking and unlocking member 60 is rotatable. Further, the dead bolt 40 is assumed to be projected from the end edge 82 of the door 81 and in the lock state as shown in FIG. 10. In this state, the sub-control slider 140 is in the forwardly projecting position where the engagement pin 148 is in engagement with the pit 149*a*. Therefore, the control projection 145 brings the control pin 55 of the see-saw member 52 into engagement with the notch 25 of the sliding plate 21 and the notch 43 of the dead bolt support member 42.

Figure 11:
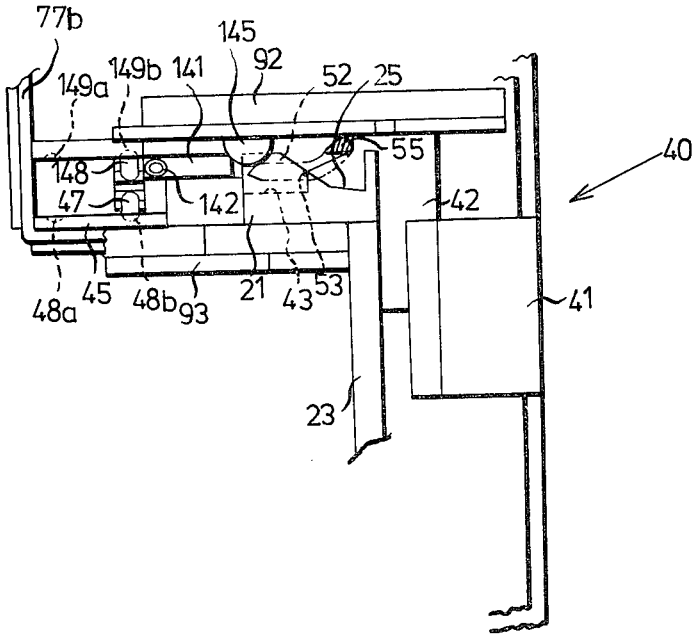
FIG. 11 is a front view of the dead bolt in the unlocked position.
Figure 12:
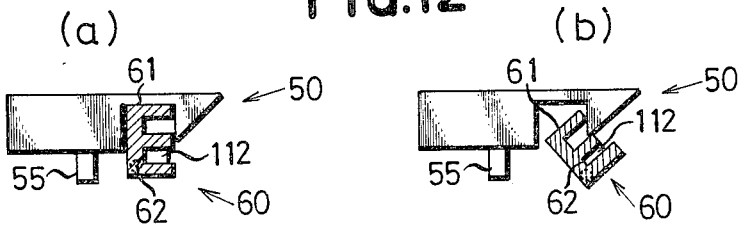
FIG. 12(*a*) and FIG. 12(*b*) are partial sectional views in explanation of the engagement of the control slider with a locking and unlocking member.

When the grip 80 is rotated in either direction, the intermediate slider 20 is moved leftwardly in FIG. 10 by the driving slider 10 as in the case of the latch bolt operating mechanism. As the intermediate slider 20 is moved leftwardly, the control slider 50, in which the control pin 55 is in engagement with the notch 25 of the sliding plate 21; the dead bolt support member 42, with which the rear end of the sliding plate 21 is in contact; and the sub-control slider 140 are moved in the same direction. In accordance with this movement, the locking and unlocking pawl 61 of the locking and unlocking member 60 is rotated and inclined backwards as shown in FIG. 12(*b*), whereby the solid head 41 of the dead bolt 40 is moved into the end edge 82 of the door 81. In other words, the dead bolt 40 is moved from the lock position to the unlock position. During this movement, the locking and unlocking pawl 61 does not disengage from the cutout 51, since the locking and unlocking pawl 61 is formed in the shape of a letter E in cross section. Further, at this moment, the pin 47 which has been in engagement with the pit 48*a* formed in the upright portion 45 secured to the rear end of the dead bolt support member 42 is released from engagement with the pit 48*a* and is then brought into engagement with the pit 48*b* by the biasing force of the plate spring 46. Likewise, with respect to the sub-control slider 140, the pin 148 is released from engagement with the pit 148*a* and is then brought into engagement with the pit 149*b*. However, the dead bolt 40 is maintained at the unlock position since the pin 47 is in engagement with the pit 48*b* of the upright portion 45 formed at the rear end of the dead bolt support member 42. In other words, the dead bolt 40 is moved into the end edge 82 of the door 81 and stays there. The sub-control slider 140 is also held at the rearwardly withdrawn position since the pin 148 is in engagement with the pit 149*b* as shown in FIG. 11. If a force exerted on the grip 80 is removed, the intermediate slider 20 returns to its original position. As a result, the connection bar 23 pushes a back plate 63 of the locking and unlocking member 60. Therefore, the locking and unlocking member 60 is returned to its original upright position. Accordingly, the control slider 50 which has been in engagement with the locking and unlocking pawl 61 is also returned to its original position. At this moment, the control projection 145 of the control slider 140, which is in contact with the seesaw member 52, slides in such a manner as to push the control pin 55 of the seesaw member 52 in the direction of bringing the control pin 55 out of engagement with both the notch 25 of the sliding plate 21 and the notch 43 of the dead bolt support member 42. Thus, the door 81 is unlocked and can be opened.

Under this unlocked state, if the intermediate slider 20 is moved by rotating the grip 80, only the latch bolt 30 can be withdrawn or projected. However, the movement of the intermediate slider 20 is not transmitted to the control slider 50 and to the sub-control slider 140. In the case where at least one of the lock units U1 and U2 is in the lock state, the control slider 50 cannot be moved since the locking and unlocking member 60 is not rotatable and accordingly the intermediate slider 20 cannot be moved, either. The result is that, if the grip 80 is rotated, only the driving slider 10 is moved. Furthermore, even if the grip 80 is rotated to its maximum range, the intermediate slider 20 and other parts connected directly thereto are not broken, since the driving slider 10 and the intermediate slider 20 are connected to each other by the coil springs 14 and 14'.

Indoor Unlocking Mechanism

When the dead bolt 40 is in the lock position, the dead bolt 40 can be moved freely from the lock position to the unlock position, irrespective of the operation of the aforesaid mechanism, by gripping the guide pin 142, which projects from the inner side of the door 81, and moving the sub-control slider 140 from the forwardly projecting position to the rearwardly withdrawn position and then moving the guide pin 49 of the dead bolt 40 or by rotating the grip 80.

Operation of the indoor unlocking mechanism will now be explained more in detail. When the solid head 41 of the dead bolt 40 is at the lock position where the solid head 41 is projected from the end edge 82 of the door 81, the sub-control slider 140 is also at the forwardly projecting position and the engagement pin 148 is in engagement with the pit 149*a* as shown in FIG. 10. Therefore, the seesaw member 52 of the control slider 50 is positioned such that an outer arm 52*a* of the seesaw member 52 rides on the control projection 145 of the sub-control slider 140, with the seesaw member 52 pivotally rotated about the shaft 53, and the control pin 55 is in engagement with both the notch 25 of the intermediate slider 20 and the notch 43 of the dead bolt support member 42. If the guide pin 142 of the sub-control slider 140 is moved from this lock state to the rearwardly withdrawn position where the pin 148 of the plate spring 147 is in engagement with the pit 149*b*, an inner arm 52*b* of the seesaw member 52 rides on the control projection 145 and the seesaw member 52 is rotated about the shaft 53, with the result that the control pin 55 is released from engagement with the notches 25 and 43. Since the movement of the dead bolt 40 is no longer hindered by any parts at this state, the dead bolt 40 can be moved to the unlock position by the guide pin 49. Alternatively, without using the guide pin 49, the dead bolt 40 can be moved to the unlock position by the gripping of operation of turning the grip 80 and causing the intermediate slider 20 to side, which operation causes the rear edge of the sliding plate 21 of the intermediate slider 20 to push the upright portion 45 of the dead bolt 40 backwards.

The dead bolt 40 positioned at the unlock position and the sub-control slider 140 positioned at the rearwardly withdrawn position can be moved to the lock position and to the forwardly projecting position, respectively, by a resetting mechanism to be mentioned.

In the lock device according to the present invention, the control projection 145 is formed in the sub-control slider 140 which is operated independently of the dead bolt 40, and the notch 43 is formed in the dead bolt support member 42, and the control pin 55 of the seesaw member 52 which is controlled by the control projection 145 is in engagement with the notch 43. Therefore, if it is tried to withdraw the dead bolt 40 from the mortise, such action cannot be done since the edge of the notch 43 comes into contact with the control pin 55, while the rotation of the control pin 55 is prevented by the control projection 145 of the sub-control slider 140 which is operated independently of the dead bolt 40. Furthermore, when the sub-control slider 140 is at the forwardly projecting position, the engagement pin 148 is in engagement with the pit 149*a* formed in the upright plate 146. Therefore, if vibrations are applied to the lock device according to the present invention, the dead bolt 40 does not move and the safety is guaranteed.

Resetting Mechanism

Referring to FIG. 3 back again, a receiver 72 formed on its upper surface with a recess 73 of the horseshoe shape is located over the driving slider 10 between the driving slider 10 between the two grips 80. A disc 74 resets on the receiver 72 which is formed in the shape of a letter H in cross section and is secured to the casing base plate 90 through the side walls 72*a* secured to the opposite sides thereof in contact with the guide plates 93 and 93'. The shaft 1 extends through the recess 73 of the horse-shoe shape of the receiver 72 in a position near the rear end thereof, so that the shaft 1 is rotatable relative to the receiver 72. The disc 74 is secured to the shaft 74 and rotates as the shaft 1 rotates. On the surface of the disc 74 juxtaposed against the receiver 72, a eccentric ring 75 is mounted, as indicated by broken lines in FIG. 3, which is eccentric with respect to the shaft 1. The eccentric ring 75 is positioned such that it partly covers the recess 73 of the horse-shoe shape. Located in a space defined by the recess 73 and the eccentric ring 75 is a projection 76*a* located at one end of a crank lever 76 arranged in the recess 73 which projection 76*a* is capable of coming into engagement with the inner periphery of the eccentric ring 75. The crank lever 76 has another projection 76*b* at the other end thereof which projection 76*b* extends outwardly from a narrower head portion of the recess 73 of the horse-shoe shape and is rotatably connected to a head portion 77*a* of the reset lever 77. The reset lever 77 includes two reset arms 77*b* and 77*b'* in the shape of a letter L, extending symmetrically in opposite directions from the head portion 77*a* thereof. The head portion 77*a* is interposed between the receiver 72 and the disc 74 and is adopted to come into engagement with the outer periphery of the eccentric ring 75. The edge of the head portion 77*a* of the reset lever 77, which is in contact with the eccentric ring 75, is formed in a symmetrical wave shape whose central portion is projecting as shown in FIG. 3.

Operation of the resetting mechanism thus constructed will now be described by referring to FIGS. 13(*a*), 13(*b* ) and 13(*c*). For the sake of convenience of explanation, the eccentric ring 75 and the crank lever 76 are assumed to be in the positions shown in FIG. 13(*a*) and the reset lever 77 is assumed to be located in a position in which it is most remote from the lock units U1 and U2.

Figure 13:
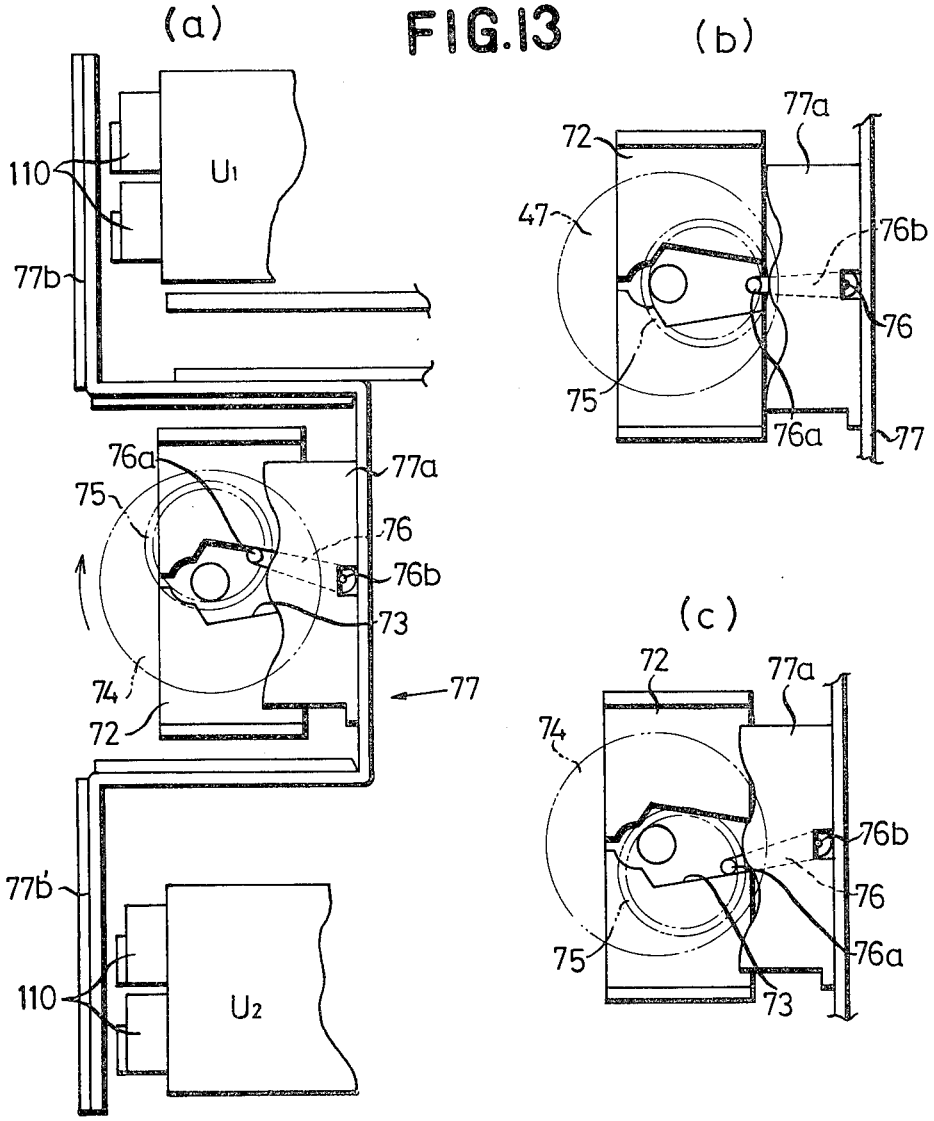
FIGS. 13(*a*), 13(*b*) and 13(*c*) are plan views of a resetting mechanism in explanation of the operation thereof.

If one of the knobs 70 is turned from inside or outside the door 81, the disc 74 is rotated through the shaft 1, for example, in the direction of the arrow shown in FIG. 13(*a*). This brings the outer periphery of the eccentric ring 75 into abutting engagement with the head portion 77*a* of the reset lever 77 and further rotation of the disc 74 causes the eccentric ring 75 to push the reset lever 77 and move the same towards the lock units U1 and U2, until the reset arms 77*b* and 77*b'* are brought into contact with the movable plates 110, such as permutation plates and safety plates of the lock units U1 and U2. As a result, the reset arms 77*b* and 77*b'* move these plates at least to the reset position R shown in FIG. 1. When the dead bolt 40 and the sub-control slider 140 are respectively located at the unlock position and at the rearwardly withdrawn position, the reset arm 77*b* pushes the rear end of the upright portion 45 secured to the dead bolt support member 42 and the rear end of the upright plate 146 of the sub-control slider 140, so that the dead bolt 40 is moved to the lock position, while the sub-control slider 140 to the forwardly projecting position. Finally, the reset lever 77 reaches a position shown in FIG. 13(*b*) in which it projects farthest from the receiver 72 and in which the eccentric ring 75 can move the reset lever 77 no further. With further rotation of the knob 70 in the same direction, the eccentric ring 75 is retracted, taking a path which is symmetrical with respect to its first path and the rear end of the crank lever 76 is brought into engagement with the inner periphery of the eccentric ring 75, so that the reset lever 77 is moved through the crank lever 76 in a direction in which the reset lever 77 moves away from the lock units U1 and U2. Finally, when the rear end of the crank lever 76 is brought to the position as shown in FIG. 13(*c*), then it is impossible to turn the knob 70 any further. Thus the reset lever 77 returns to its original position. This one reciprocating movement of the reset lever 77 resets the movable plates 110 of the two lock units U1 and U2 in the standby position and the dead bolt 40 is located in the lock position.

The next operation of the resetting mechanism is performed by rotating the disc 74 in the direction opposite to the arrow in FIG. 13(*a*).

According to the present invention, the reliability and safty of the lock device have been significantly improved and the thickness and width of the lock device can be decreased, so that the attachement of the lock device to standarized doors is very simple.

The mechanism for rotating the latch bolt 30 is not limited to the previously mentioned mechanism. The following modification can also be employed instead.

Figure 14:
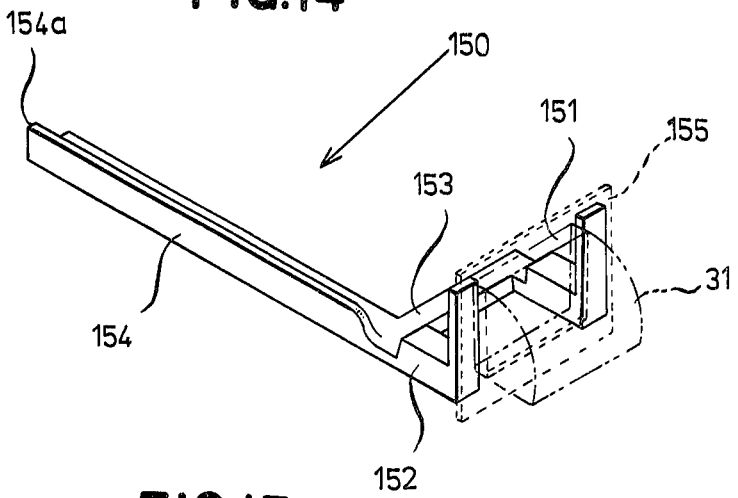
FIG. 14 is a perspective view of another mechanism for rotating the latch bolt.
Figure 15:
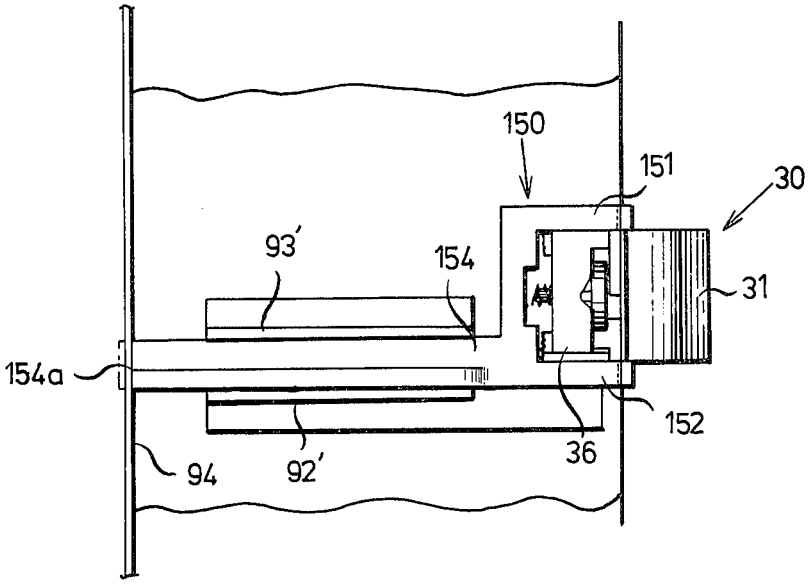
FIG. 15 is a front view of the mechanism in FIG. 14.

Referring to FIG. 14, reference numeral 150 represents a rotation prevention member for preventing the rotation of the latch bolt 30 which is rotatably supported by the latch bolt support member 36. The rotation prevention member 150 comprises rotation prevention frames 151 and 152 capable of holding the top portion 31 of the latch bolt 30 loosely therebetween, a connection frame 153 for connecting the rotation prevention frames 151 and 152 to each other, and lod-like member 154 which extends rearwardly from the rotation prevention frame 152. The rotation prevention member 150 is disposed in such a manner that the rod-like member 154 is held between the partition plate 92' and the guide plate 93' and that the prevention member 150 is capable of sliding along the casing base plate 90 as shown in FIG. 15. When the rotation prevention member 150 is located at the rotation prevention position indicated by the solid line in FIG. 15, the top portion 31 of the latch bolt 30 is held between the two rotation prevention frames 151 and 152. Therefore, the latch bolt 30 cannot be rotated. However, when the rotation prevention member 150 is located at the rotation prevention release portion indicated by the alternate long and two short dash line in FIG. 14, the rotation prevention frames 151 and 152 are located away from the top portion 31 of the latch bolt 30, so that the latch bolt 30 can be rotated. When the latch bolt 30 is located in the unrotatable position, a rear end portion 154*a* of the rod-like member 154 extends substantially to the left end of the casing base plate 90 in FIG. 15. Therefore, when a casing side plate 94 is attached to the rear end portion 154*a* of the rod-like member 154, the rotation prevention member 150 is no longer moved to the rotation prevention release position. Therefore, the latch bolt 30 cannot be rotated in that position. A stopper (not shown) for preventing the rotation prevention member 150 from sliding beyond the range between the rotation prevention position and the rotation prevention release position is provided.

In the thus constructed ratch bolt rotation mechanism, when the inclined surface of the top portion 31 of the latch bolt 30 is directed in the improper direction for attaching the lock device to a door, the casing side plate 94 is detached and the rotation prevention member 150 is moved to the rotation prevention release position. The latch bolt 30 is then rotated in the right direction.

Furthermore, the rotation of the latch bolt 30 can also be prevented by attaching a window-shaped frame 155, which allows the latch bolt 30 to be loosely fitted therein, to the rotation prevention frames 151 and 152.

The lock units U1 and U2 for use in the lock device according to the present invention will now be described. For the sake of convenience of explanation of the lock units U1 and U2, one lock unit U will now be explained.

Figure 16:
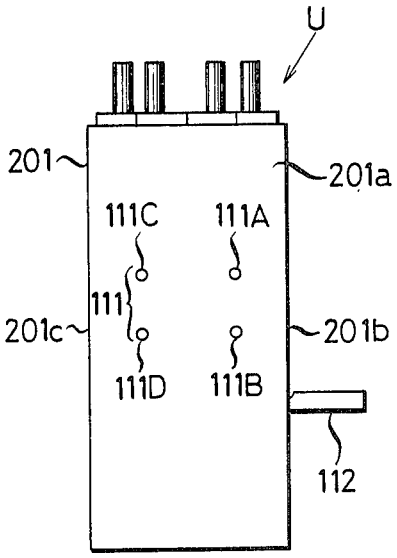
FIG. 16 is a plan view of a lock unit for use in the present invention.
Figure 18:
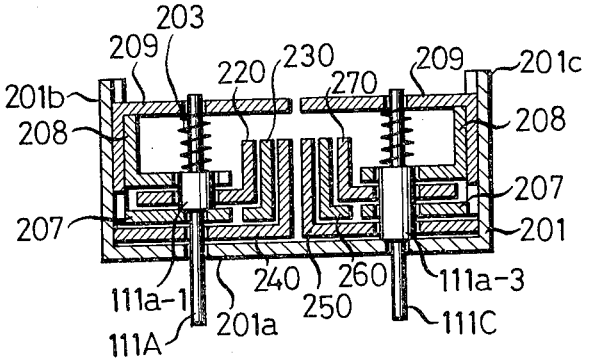
FIG. 18 is a sectional view, on an enlarged scale, taken along the line XIII—XIII of FIG. 17.
Figure 19:
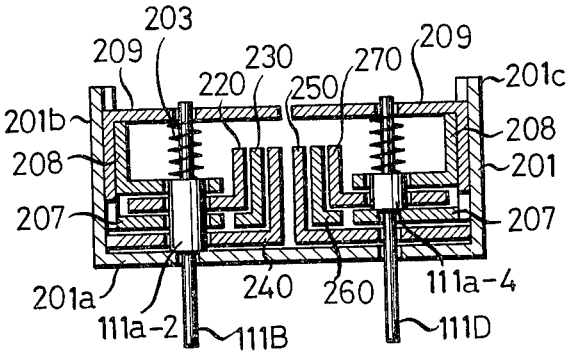
FIG. 19 is a sectional view, on an enlarged scale, taken along the line IXX—IXX of FIG. 17.

Referring to FIG. 16, four pushbuttons 111 (111A, 111B, 111C and 111D) are projected from a flat portion of a unit casing 201. The lock unit U can be set in the unlock state when the pushbutton 111C is first depressed and the bushbuttons 111A and 111B in the indicated order as will become apparent from the explanation to be made. A locking and unlocking bar 112 is rotatable in the direction of the arrow in FIG. 20. As shown in FIG. 18 and FIG. 19, the unit casing 201 is formed in the shape of a letter U in cross section.

Figure 20:
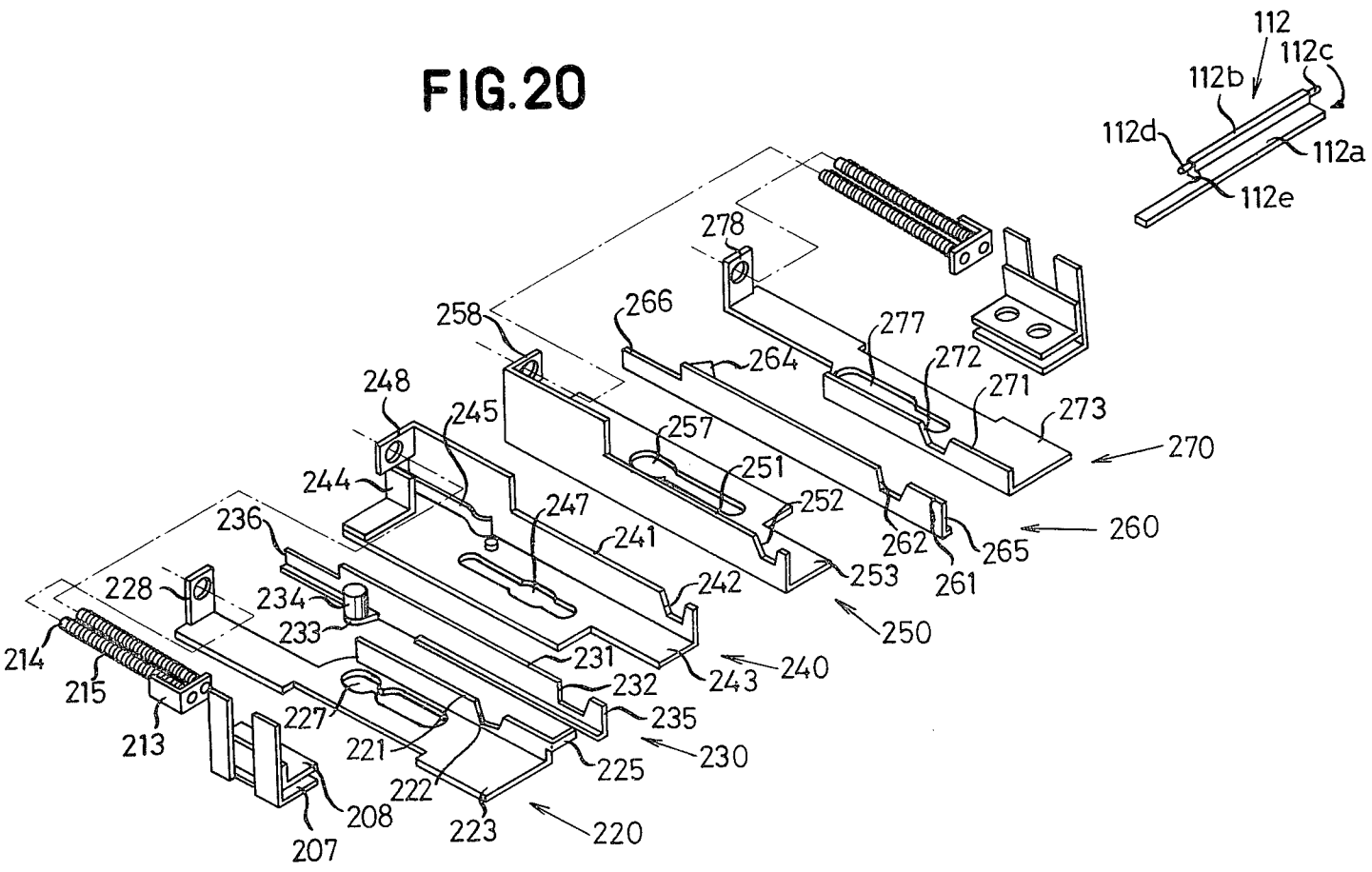
FIG. 20 is an exploded perspective view of the main parts of the lock unit for use in the present invention.

Referring back to FIG. 20, the locking and unlocking bar 112 includes a tongue 112*b* which extends in the shape of a letter L in cross section from a rod portion 112*a;* and pins 112*c* and 112*d* which are formed on the opposite ends of the tongue 112*b* and fitted into the openings formed in two casing side plates 201*b* and 201*c* of the unit casing 201. Thus, the locking and unlocking bar 112 is rotatable about the pins 112*c* and 112*d* as shown in FIG. 20. A cutout 112*e* is formed in the rod portion 112*a*, in a position near the pin 112*d* as shown in FIG. 20, in order not to prevent the rotation of the locking and unlocking bar 112.

Figure 17:
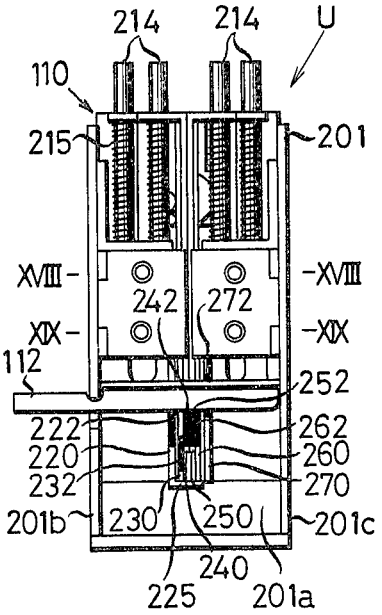
FIG. 17 is a view of the back side of the lock unit in FIG. 16.

Referring to FIG. 17, the locking and unlocking bar 112 is rotatably supported by the casing side plates 201*b* and 201*c* in such a manner as to bridge the two casing side plates 201*b* and 201*c* in the direction normal thereto. On the left side between the locking and unlocking bar 112 and a casing bottom plate 201*a* of the unit casing 201, there are disposed three movable plates 110 side by side, namely a permutation driving plate 220, a first sliding plate 230 and a permutation driven plate 240 in such a manner as to cross the locking and unlocking bar 112 at a ring angle. On the right side, another three movable plates 110, namely a permutation start plate 250, a second sliding plate 260 and a release operation safety plate 270 are likewise disposed side by side. The movable plates 110 are movable upwards and downwards in FIG. 17 between the standby position and the operation position.

Referring to FIG. 20, the movable plates 220, 230, 240, 250, 260 and 270 respectively include stop portions 221, 231, 241, 251, 261 and 271 for stopping the rotation of the locking and unlocking bar 112 when any of them comes immediately below the locking and unlocking bar 112; and nonstop portions 222, 232, 242, 252, 262 and 272, for example, V-shaped notches, for permitting the rotation of the locking and unlocking bar 112 when all of them come immediately below the locking and unlocking bar 112.

Further, in FIG. 20, the movable plates 220, 230, 240, 250, 260 and 270 respectively include tongue portions 223, 233, 243, 253, 263 and 273 in the shape of a letter L which extend from the lower ends of the respective movable plates in the direction of either the side casing plate 201*b* or the casing side plate 201*c*.

Figure 21:
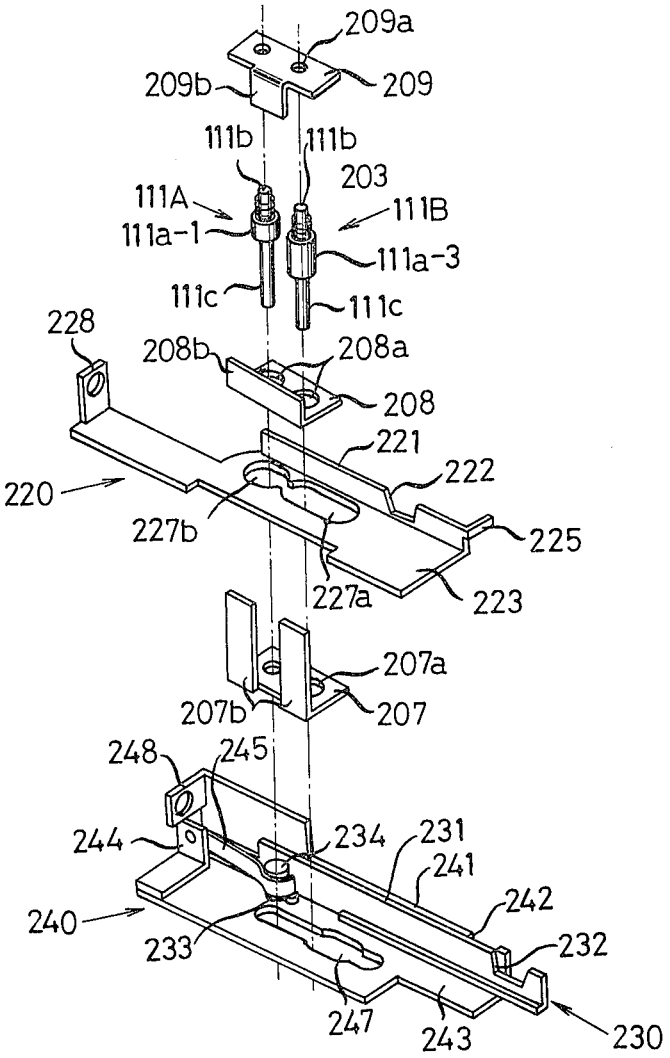
FIG. 21 and FIG. 22 are exploded perspective views of the main parts of the lock unit, particularly showing the superimposed relation of the main parts.

Referring to FIG. 20 and FIG. 21, a stopper 244 for restricting the movable range of the first sliding plate 230 is secured to a rear end portion of the tongue portion 243 of the permutation driven plate 240 as shown in FIG. 20. To the stopper 244 is fixed one end of a plate spring 245. The tongue portion is small and is secured to a rearward portion of the first sliding plate 230. To the upper surface of the tongue portion 233, a pin 234 is secured. The pin 234 can be brought into elastic engagement with the plate spring 245. The free end of the plate spring 245 is formed in a wavelike shape for easy engagement with the pin 234. Since the plate spring 245 is disposed in such a manner that its holding surface is directed to the inner side of the permutation driven plate 240, the lock unit U can be made compact in size and it is easy to adjust the biasing force of the plate spring 245.

Figure 22:
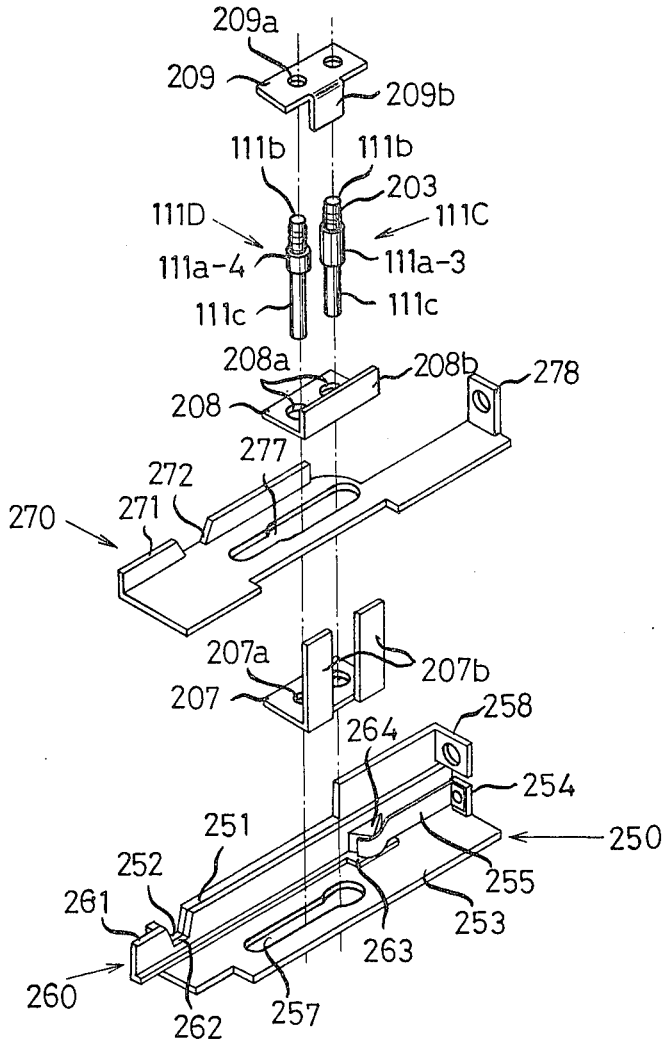

Referring to FIG. 22, a stopper 254 is secured to the tongue portion 253 of the permutation start plate 250 as in the case of the permutation driven plate 240. To the stopper 254 is secured to one end of a plate spring 255. Further, in the tongue portion 263 of the second sliding plate 260, a projected portion 264 is formed, which performs the similar function to that of the pin 234 of the first sliding plate 230.

As shown in FIG. 20, the permutation driving plate 220 includes a carriage portion 225 which is capable of coming into contact with a front edge 235 of the first sliding plate 230 and a front edge 265 of the second sliding plate 260. When the permutation driving plate 220 is moved by a predetermined distance (hereinafter referred to as one stage), the first sliding plate 230 and the second sliding plate 260 can be carried by one stage through the carriage portion 225. In order that the first and second sliding plates 230 and 260 can be securely carried by the carriage portion 225, a notch is formed in each of the front edges of the permutation driven plate 240 and of the permutation start plate 250. The movable ranges of the first and second sliding plates 230 and 260 are restricted by the stoppers 244 and 254 and the carriage portion 225. There is a space between the permutation driven plate 240 and the stopper 244, and into this space, a rear end 236 of the first sliding plate 230 is inserted. Likewise, there is a space between the permutation start plate 250 and the stopper 254 and into that space, a rear end 266 of the second sliding plate 260 is inserted. A stop portion 228 extends from the rear end of the tongue portion 223 at a right angle with respect to the tongue portion 223 in the direction of the opening portion of the unit casing 201. Likewise, a stop portion 248 extends from the rear end of the permutation driven plate 240, at a right angle with respect to the side plate 201*b* of the casing 201. The stop portions 228 and 248 are formed in such sizes that they do not overlap each other and do not hinder the movement of the movable plates 110 (refer to FIG. 17). On the other hand, in the tongue portion 223 of the permutation driving plate 220 and in the tongue portion 243 of the permutation driven plate 240, slots 227 and 247 are respectively formed near the respective stop portions 227 and 247. Each of the slots 227 and 247 consists of a large-diameter portion and a small-diameter portion which are connected to each other. The longitudinal direction of each of the slots 227 and 247 is parallel to the moving direction of the movable plates 110.

The release operation safety plate 270 has the same mechanism as that of the permutation driving plate 220, except that the release operation safety plate 270 does not include a carriage portion and that the position of the non-stop portion 272 of the release operation safety plate 270 is different from that of the non-stop portion 222 of the permutation driving plate 220. The permutation start plate 250 and the permutation driven plate 240 are also substantially the same in mechanism. The first sliding plate 230 is different from the second sliding plate 260 in the positions of the non-stop portions 232 and 262. Reference numeral 258 represents a stop portion of the permutation start plate 250, while reference numeral 278 represents a stop portion of the release operation safety plate 270.

The lock unit U is assembled by superimposing those movable plates 11*o* one over the other. FIG. 21 shows how to assemble the left side portion of the lock unit U shown in FIG. 17. As can be seen from FIG. 21, on the casing bottom plate 201*a* of the casing 201, the tongue portion 243 of the permutation driven plate 240 is first placed. On the tongue portion 243 is then placed the tongue portion 233 of the first sliding plate 230. Further, on the tongue portion 233 is placed the tongue portion 223 of the permutation driving plate 220. Referring to FIG. 18 and FIG. 19, the construction of these members superimposed is shown. Referring to FIG. 22, with respect to the right side portion of the lock unit U, the tongue portion 253 of the permutation start plate 250 is first placed on the casing bottme plate 201*a* of the casing 201. The tongue portion 263 of the second sliding plate 260 is then placed on the tongue portion 253. Further, the tongue portion 273 of the release operation safety plate 270 is placed on the tongue portion 263 as shown in FIG. 22. Between the permutation driven plate 240 and the permutation driving plate 220 is inserted a first guide plate 207, while between the permutation start plate 250 and the release operation safety plate 270 is inserted another first guide plate 207 in order to guarantee smooth and stable movement of these superimposed movable plates. Furthermore, a second guide plate 208 is disposed on the tongue 223 of the permutation driving plate 220, and another second guide plate 208 is disposed on the tongue 273 of the release operation safety plate 270.

A pair of the first guide plate 207 and the second guide plate 208 is secured to both the casing side plates 201*b* and 201*c*. Therefore, the first and second guide plates 207 and 208 are substantially integral. As shown in FIGS. 20 to 22, the guide plate 207 includes a forked attachment arm 207*b* Into a longitudinal space formed by the attachment arm 207*b*, an attachment portion 208*b* of the guide plate 208, and the casing side plate 201*b* or 201*c*, there can be inserted an attachment portion 209*b* of a guide support plate 209 to be mentioned.

A movement means for moving the thus superimposed movable plates by one stage is provided. The mechanism of the movement means will now be explained. Two pushbuttons 111 extend through the slots 227 and 247, and the slots 277 and 257 formed in the movable plates 110. Each pushbutton 111 includes a base portion 111*a* in the middle portion thereof and small-diameter rod portions, 111*b* and 111*c* at the opposite end portions thereof. The small-diameter rod portion 111*b* is supported by the guide support plate 209 with the upper end of the rod portion 111*b* fitted into a guide hole 209*a* of the guide support plate 209. The small-diameter rod portion 111*c* extends through the casing bottom plate 201*a* of the casing 201 and projects therefrom as shown in FIG. 16. Between the guide support plate 209 and the base portion 111*a* of the pushbutton 111, the small-diameter rod portion 111*b* has a coil spring 203 mounted around it, whereby the base portion 111*a* of the pushbutton 111 is always urged into pressure contact with the casing bottom plate 201*a* in the standby position. As shown in FIG. 18 and FIG. 21, in this embodiment, a base portion 111*a*-1 of a pushbutton 111A extends through a guide hole 208*a* of the guide plate 208 and a short-large-diameter portion 227*b* of the slot 227 of the permutation driving plate 220 and rests on the guide plate 207. Furthermore, as shown in FIGS. 19 and 21 a base portion 111*a*-2 of the pushbutton 111B extends through the guide hole 208*a* of the guide plate 208, the long-large-diameter portion 227*a* of the permutation driving plate 220, the guide hole 207*a* of the guide plate 207, the large-diameter portion of the permutation driven plate 240 and rests on the casing bottom plate 201*a*. Therefore, the pushbutton 111A belongs to the permutation driving plate 220, while the pushbutton 111B belongs to the permutation driven plate 240.

Furthermore, as shown in FIG. 18 and FIG. 22, a base portion 111*a*-3 of a pushbutton 111C extends through the guide hole 208*a* of the guide plate 208, a large-diameter portion of the slot 277 of the release operation safety plate 270, the guide hole 207*a* of the first guide plate 207, and a large-diameter portion of the slot 257 of the permutation start plate 250, and rests on the casing bottom plate 201*a* of the casing 201. On the other hand, as shown in FIG. 19 and FIG. 22, a base portion 111*a*-4 of a pushbutton 111D extends through the guide hole 208*a* of the guide plate 208, the slot 277 of the release operation safety plate 270, and rests on the first guide plate 207. Therefore, the pushbutton 111C belongs to the permutation start plate 250, while the pushbutton 111D belongs to the release operation safety plate 270.

Referring to FIG. 17 and FIG. 20, a support member 213 with a portion projecting into the inside of the casing unit 201 is secured to each of the inner surface of the casing side plate 201*b* and that of the casing side plate 201*c*, adjacent the guide plates 207 and 208. The guide member 213 supports one end of two guide rods 214 by the projected portion thereof. The other ends of the guide rods 214 pass through small holes formed in the stop portions 228, 248, 258 and 278. Each guide rod 214 has a coil spring 215 mounted around it between the support member 213 and one of the stop portions 228, 248, 258 and 278. By the biasing force of each of the coil springs 215, each of the movable plates 220, 240, 250 and 270 is urged upwards in FIG. 17. However, the movable plates 220, 240, 250 and 270 are caused to stay in the standby position, since they are stopped by the base portions 111*a* of the pushbuttons 111, each of which belongs to a step portion between the large-diameter portion and the small-diameter portion of the slot formed in each of the tongues of the movable plates 220, 240, 250 and 270. By depressing any of the pushbuttons, the standby state moves onto the operating state. For instance, referring to FIG. 18 and FIG. 19, when the pushbutton 111A is depressed upwards, the base portion 111*a*-1 of the pushbutton 111A is released from engagement with the short, large-diameter portion 227*b* of the slot 227 of the permutation driving plate 220, so that the permutation driving plate 220 is moved by the biasing force of the spring 215, and the front end of the slot 227 of the permutation driving plate 220 then comes into contact with the base portion 111*a*-2 of the pushbutton B, with the result that the permutation driving plate 220 is stopped. The distance of this movement of the permutation driving plate 220 equals the aforementioned one stage.

When the lock unit U is in the standby position as shown in FIG. 17, the respective non-stop portions 222, 242 and 252 of the permutation driving plate 220, the permutation driving plate 240 and the permutation start plate 250 (which non-stop portions are the notches indicated in solid black in FIG. 17) are shifted downwards by one stage from immediately below the locking and unlocking bar 112 in FIG. 17, while the non-stop portion 232 of the second sliding plate 260 is shifted by two stages from immediately below the locking and unlocking bar 112. The non-stop portion 262 of the second sliding plate 260 and the non-stop portion 252 of the permutation start plate 250 are in the same position. Furthermore, the non-stop portion 272 of the release operation safety plate 270 is located right under the locking and unlocking bar 112.

Stated differently, the stop portions 221, 231, 241, 251 and 261 are located immediately below the locking and unlocking bar 112, and only the non-stop portion 272 of the release operation safety plate 270 is located right under the locking and unlocking bar 112. Therefore, the locking and unlocking bar 112 cannot be rotated.

When the locking unit U is in the unlocking state, all the non-stop portions 222, 232, 242, 252, 262 and 272 are located right under the locking and unlocking bar 112, so that the locking and unlocking bar 112 can be rotated.

When the pushbutton 111C of the lock unit U which is in the standby position is first depressed, the base portion 111*a*-3 of the pushbutton 111C is released from the engagement with the slot 257 of the permutation start plate 250, so that the permutation start plate 250 is moved upwards by one stage in FIG. 16 by the biasing force of the spring 215. At this moment, the second sliding plate 260 is also moved together with the permutation start plate 250. As a result, the non-stop portion 252 of the permutation start plate 250 and the non-stop portion 262 of the second sliding plate 260 come right under the locking and unlocking bar 112. As a result, the front edge 265 of the second sliding plate 260 is located away by one-stage from the carriage portion 225 of the permutation driving plate 220.

When the pushbutton 111A is then depressed, the base portion 111*a*-1 of the pushbutton 111A is released from engagement with the slot 227 of the permutation driving plate 220, so that the permutation driving plate 220 is moved by stage. In this case, the carriage portion 225 is located away from the front edge 265 of the second sliding plate 260. However, the carriage portion 225 is in contact with the front edge 235 of the first sliding plate 230. Therefore, the first sliding plate 230 is moved by one stage by the permutation driving plate 220 through the carriage portion 225. When the pushbutton 111A is depressed, the first sliding plate 230 is moved against the biasing force of the plate spring 245 and the pin 234 is stopped by the stopper 244. When the first sliding plate 230 has been moved and is then stopped, the non-stop portion 232 of the first sliding plate 230 and the non-stop portion 242 of the permutation driven plate 240 come to the same position, and those portions are each located at a position shifted by one stage from the position of the locking and unlocking bar 112. At this moment, the non-stop portion 222 of the permutation driving plate 220 comes right under the locking and unlocking bar 112.

When the pushbutton 111B is finally depressed, the permutation driven plate 240 is moved by one stage, together with the first sliding plate 230, so that all the non-stop portions 222, 232, 242, 252, 262 and 272 come right under the locking and unlocking bar 112, whereby the lock unit U is brought to the unlock state. If the pushbutton 111D which has not yet been depressed is depressed, the release operation safety plate 270 is moved upwards in FIG. 17, and the stop portion 271 of the release operation safety plate 270 comes immediately below the locking and unlocking bar 112. As a result, the lock unit U is brought to the locked state.

The unlocking condition for the lock unit U in this embodiment is limited to only one choice which is to depress the pushbuttons 111C, 111A, 111B in the indicated order and not to depress the pushbutton 111D. Therefore, if the pushbutton 111A is first depressed, the permutation driving plate 220 is moved by one stage and the first sliding plate 230 and the second sliding plate 260 are also moved by the carriage portion 225 of the permutation driving plate 220. As a result, the non-stop portion 262 of the second sliding plate 260 comes to a position shifted by one stage away from the non-stop portion 252 of the permutation start plate 250. Therefore, even if the pushbutton 111C is then depressed and the non-stop portion 252 comes right under the locking and unlocking bar 112, the non-stop portion 262 of the second sliding plate 260 is shifted upwards from the non-stop portion 252. Therefore, the lock unit U is not brought to the unlocking state.

Furthermore, if the pushbutton 111C is first depressed and the pushbutton 111B is then depressed, the first sliding plate 230 is not carried away by the carriage portion 225 when depressing the pushbutton 111A next. As a result, the first sliding plate 230 is moved by one stage only. Therefore, the lock unit U is not brought to the unlocking state.

After any of these pushbuttons is depressed, the lock unit U can be returned to the standby position by operating the resetting mechanism of the lock device according to the present invention.

As mentioned above, the unlocking condition of the lock unit U can be limited to the only one operating procedure for depressing the pushbuttons 111 by disposing the permutation start plate 250 and the second sliding plate 260 in the lock unit U. Therefore, there is no risk that the unlocking procedure for the lock unit U may be the same as that of any of the conventional lock units.

Figure 23:
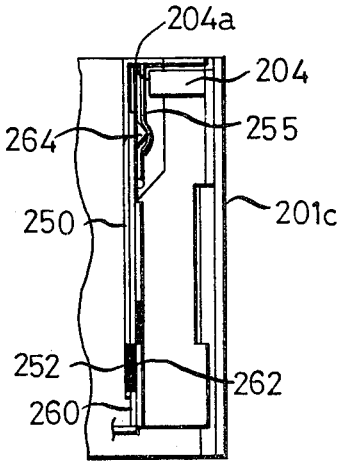
FIG. 23 is a view of a half portion of the lock unit in the standby position, with certain parts being eliminated.
Figure 24:
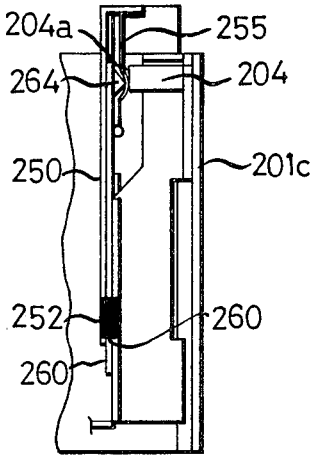
FIG. 24 is a view showing the half portion of the lock unit in FIG. 23, in which the permutation start plate and the second sliding plate are located to their operational positions.
Figure 25:
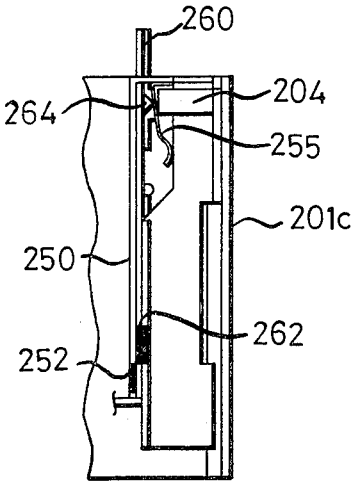
FIG. 25 is a view showing the half portion of the lock unit in FIG. 23, in which only the second sliding plate has been moved from its standby position shown in FIG. 23.

Referring to FIGS. 23, 24 and 25, the construction of the lock unit for use in the present invention will now be described in more detail, particularly as to how the precise movements of the movable plates 110 have been attained and accordingly how such high reliability of the lock unit has been achieved.

FIG. 23 shows the permutation start plate 250 which is in the standby position. When the pushbutton (not shown) belonging to the permutation start plate 250 is depressed, the permutation start plate 250 is moved by one stage, and together with the permutation start plate 250, the second sliding plate 260 is also moved by one stage, with the pin 264 secured to the second sliding plate 260 being held by the top portion of the plate spring 255 which is fixed to the permutation start plate 250. The permutation start plate 250 is then brought to a sudden stop since the front edge of the slot (not shown) formed in the permutation start plate 250 comes into contact with the pushbutton. However, the second sliding plate 260 does not stop immediately the moment the permutation start plate 250 stops due to a inertia force thereof and advances further beyond the position where the permutation start plate 250 stops, and then stops. Stated differently, the second sliding plate 260 is capable of moving relative to the permutation start plate 250 and therefore does not stop upon the stopping of the permutation start plate 250, but stops after having advanced beyond one stage. Therefore, the non-stop portion 262 comes to a position away from its right position, that is, a position shifted backwards from immediately below the locking and unlocking bar (not shown). As a result, even if the pushbuttons are depressed in the proper order, the unlocking of the lock device cannot be performed.

In order to provide a solution to this problem, a holding member 204 is provided on the casing side plate 201*c* of the casing 201. The holding member 204 is disposed in a position in which a holding portion 204*a* of the holding member 204 is positioned in close proximity to the surface of the plate spring 255 opposite to the holding surface and when the second sliding plate 260 is moved by one stage, the holding member 204 comes to the same position as that of the pin 264.

By disposing the holding member 204 in the above-mentioned position, even if the permutation start plate 250 is moved and the second sliding plate 260 is also moved together with the permutation start plate 250, the plate spring 255 is held tightly between the holding surface 204*a* of the holding member 204 and the pin 264. Therefore, the pin 264 cannot advance beyond the holding surface of the plate spring 255 in spite of the inertia force of the sliding plate 260, and accordingly it does not occur that the second sliding plate 260 advances relative to the permutation start plate 250 when the permutation start plate 250 stops.

Thus the second plate 260 is forcibly stopped by the plate spring 255 and the previously mentioned problem can be eliminated. A holding member of the above-mentioned type is also attached to the permutation driven plate 240, whereby the movements of the first sliding plate 230 and of the second sliding plate 240 can be controlled precisely. Furthermore, referring to FIG. 25 when the permutation start plate 250 is in the standby position and the second sliding plate 260 is moved by one stage by the permutation driving plate 220 through the carriage arm 225, and therefore the second sliding plate 260 is moved by one stage away from the permutation start plate 250, the second sliding plate 260 is not moved any further by the holding member 204 in the same manner as mentioned in the case in FIG. 24.

Referring back to FIG. 1, in the embodiment of a lock device according to the present invention, the two lock units U1 and U2 are employed, and the locking and unlocking bar 112 is rotatable about the pins 112*c* and 112*d* disposed at opposite ends thereof. Therefore, it is preferable that the pins 112*c* and 112*d* and the pin 64 which constitutes the rotation center of the opening and closing member 60 be arranged in a line.

What is claimed is:

1. A lock device of the pushbutton system attached to a casing base plate comprising:

at least one lock unit adapted to permit a locking and unlocking bar to rotate when pushbuttons of a number r out of a total number n are depressed in such a manner as to meet the requirements for unlocking the lock unit;

a resetting mechanism for returning said lock unit to a standby position by one reciprocating movement of a reset lever performed by turning a knob;

a locking and unlocking pawl member formed in a rotatable locking and unlocking member which is connected to said locking and unlocking bar of said lock unit;

an intermediate slider which can be reciprocated through a driving slider by turning a grip for opening and closing the door;

a dead bolt which is movable between a lock position and an unlock position, in the movable direction of said intermediate slider, said dead bolt being partly superimposed on said intermediate slider;

a notch which is formed in said intermediate slider in a portion where said intermediate slider and said dead bolt are superimposed on each other;

a notch which is formed in said dead bolt at a position slider;

a control slider which is in engagement with said locking and unlocking pawl member, said control slider being situated above the superimposed portion of said intermediate slider and said dead bolt and movable in the same direction as that of said intermediate slider when said intermediate slider is moved;

a seesaw member having a control pin at one end thereof, said seesaw member disposed in said control slider and said control pin capable of being brought into engagement with said notches of said intermediate slider and said dead bolt and released from engagement with the same;

a sub-control slider which is disposed adjacent said control slider, said sub-control slider movable in the same direction as that of said intermediate slider, between a forwardly projecting position and a rearwardly withdrawn position, and also independently movable from the forwardly projecting position to the rearwardly withdrawn position and vice versa by an operation from inside the room; and a control projection which is disposed in said sub-control slider, said control projection capable of holding said seesaw member at a position where said control pin is in engagement with said notch of said intermediate slider and with said notch of said dead bolt when said sub-control slider is located at the forwardly projecting position, and also capable of holding said seesaw member at a position where said control pin is out of engagement with said notch of said intermediate slider and with said notch of said dead bolt when said sub-control slider is located at the rearwardly withdrawn position.

2. A lock device as claimed in claim 1, wherein when said sub-control slider is at the forwardly projecting position, said sub-control slider can be moved from the forwardly projecting position to the rearwardly withdrawn position in accordance with the movement of said intermediate slider.

3. A lock device as claimed in claim 1, wherein when said sub-control slider is at the rearwardly withdrawn position, said sub-control slider can be moved from the rearwardly withdrawn position to the forwardly projecting position in accordance with the movement of said reset lever.

4. A lock device as claimed in claim 1, further comprising a holding means for holding said sub-control slider at the forwardly projecting position and at the rearwardly withdrawn position.

5. A lock device as claimed in claim 4, wherein said holding means comprises an engagement pin which is secured to said causing base plate through a plate spring, and two pits formed in said sub-control slider, with which pits said engagement pin can be brought into engagement.

6. A lock device as claimed in claim 1, wherein said intermediate slider has two separate sliding plates, between which said driving plate is disposed side by side through two guide plates secured to said casing base plate, with one guide plate disposed between one sliding plate and said driving plate, and the other guide plate disposed between the other sliding plate and said driving plate.

7. A lock device as claimed in claim 1, wherein said reset mechanism comprises:

a receiver formed on one surface thereof with a guide recess;

a disc member which is juxtaposed against said receiver and which can be rotated by a knob;

an eccentric ring member formed on said disc at the side facing said receiver, said eccentric ring member being eccentric with respect to the rotation center of said disc;

a lever which is disposed within said guide recess, one end of which is in engagement with the inner periphery of said eccentric ring member;

a reset lever in which the other end of said lever is in engagement and which is capable of returning the movable plates of said lock unit to a reset position;

a head portion secured to said reset lever, said head portion being in contact with the outer periphery of said eccentric ring member, and the central portion of said head being formed in a wavelike shape and projecting towards said eccentric ring member.

8. A lock device as claimed in claim 1, wherein said locking and unlocking pawl member is formed in the shape of a letter E in cross section.

9. A lock device as claimed in claim 1, wherein the rotation center of said locking and unlocking bar and that of said locking and unlocking member are arranged on the same line.

10. A lock device as claimed in claim 1, wherein said lock unit comprises:

a locking and unlocking bar which is rotatably disposed in a unit casing;

a plurality of movable plates which are capable of moving between a standby position and an operating position which are separated by a predetermined one-stage distance, said movable plates containing at least a permutation driving plate, a permutation driven plate and a permutation start plate;

a first sliding plate which is carried by said permutation driven plate and is movable relative to and parallel to said permutation driven plate;

a second sliding plate which is carried by said permutation start plate and is movable relative to said permutation start plate;

a plurality of pushbuttons, each of which belongs to one said movable plates;

a movement means capable of moving said movable plates from the standby position to the operating position upon depressing said pushbuttons belonging to each of said movable plates;

a carriage portion capable of carrying said first sliding plate and said second sliding plate by said one-stage distance in accordance with the movement of said permutation driving plate from the standby position to the operating position when said permutation driving plate, said permutation driven plate and said permutation start plate are located in the standby position; and stop-portions and non-stop-portions formed in said movable plates and said first sliding plate and said second sliding plate, said stop-portions capable of preventing the rotation of said locking and unlocking bar, and said non-stop portions capable of permitting the rotation of said locking and unlocking bar, and said non-stop portions of said permutation driving plate, said permutation driven plate, said permutation start plate and said second sliding plate being formed by one-stage distance away from said locking and unlocking bar, and said non-stop portion of said first sliding plate being formed two-stage distance away from said locking and unlocking bar.

11. A lock device as claimed in claim 10, wherein said lock unit further comprises a projection in each of said first sliding plate and said second sliding plate, a plate spring member in each of said permutation driven plate and, said permutation start plate, said projections capable of being brought into elastic engagement with said projections, and the holding surface of each of said plate springs facing one side surface of said permutation driven plate and one side surface of said permutation start plate.

12. A lock device as claimed in claim 10 or claim 11, wherein said lock unit further comprises a holding member located near said projection and said plate spring member of each of said permutation driven plate and said permutation start plate when said permutation driven plate and said permutation start plate are in the operating position.

* * * * *